US008413382B2

(12) United States Patent
Uto et al.

(10) Patent No.: US 8,413,382 B2
(45) Date of Patent: Apr. 9, 2013

(54) HINGE AND DOOR UNIT

(75) Inventors: Ryoji Uto, Tokyo (JP); Keitaro Yokogawa, Hyogo (JP); Takahiro Goto, Hyogo (JP); Shigemi Takeuchi, Hyogo (JP)

(73) Assignee: Caterpillar SARL, Geneva (CH)

( * ) Notice: Subject to any disclaimer, the term of this patent is extended or adjusted under 35 U.S.C. 154(b) by 0 days.

(21) Appl. No.: 13/056,185

(22) PCT Filed: May 27, 2009

(86) PCT No.: PCT/JP2009/059685

§ 371 (c)(1),
(2), (4) Date: Jan. 27, 2011

(87) PCT Pub. No.: WO2010/026806

PCT Pub. Date: Mar. 11, 2010

(65) Prior Publication Data

US 2011/0126469 A1 Jun. 2, 2011

(30) Foreign Application Priority Data

Sep. 2, 2008 (JP) ..... 2008-224582
Jan. 7, 2009 (JP) ..... 2009-002039

(51) Int. Cl.
*E05D 11/06* (2006.01)
*E06B 3/36* (2006.01)
*E05C 17/22* (2006.01)

(52) U.S. Cl.
USPC ..... 49/397; 49/381

(58) Field of Classification Search ..... 49/381, 49/397; 296/190.11, 146.11; 180/89.17; 16/319, 349, 350, 351, 352, 353, 82, 362, 16/363
See application file for complete search history.

(56) References Cited

U.S. PATENT DOCUMENTS 1,722,331 A * 7/1929 Knapp ..... 49/399
3,967,850 A * 7/1976 Whisler ..... 296/146.1
3,969,789 A * 7/1976 Wize ..... 16/297
4,263,853 A * 4/1981 Robertson ..... 105/378
4,322,107 A * 3/1982 Ishizuka et al. ..... 296/146.11

(Continued)

FOREIGN PATENT DOCUMENTS

JP 63-133650 U 9/1988
JP 8-105432 A 4/1996

(Continued)

*Primary Examiner* — Katherine Mitchell
*Assistant Examiner* — Justin Rephann
(74) *Attorney, Agent, or Firm* — McDermott Will & Emery LLP

(57) ABSTRACT

A second hinge plate supported pivotally on a first hinge plate using a shaft member so as to open and close. In the second hinge plate, a bracket is molded integrally at the upper edge of the end opposite the shaft member. A vertical shaft of a hold-stay rod is loosely fitted into a shaft hole of the bracket so as to move rotationally and slide in a vertical direction. A horizontal shaft of the hold-stay rod is inserted into a guide hole of a guide plate welded to the first hinge plate and slidable, and a stopper is folded and formed at the leading end of the hold-stay rod. The stopper is inserted into an engaging hole by movement from a guide to a receiving plate due to the opening movement of the second hinge plate and can be taken out from the engaging hole by a pushing-up operation.

6 Claims, 29 Drawing Sheets

U.S. PATENT DOCUMENTS

| | | | | |
|---|---|---|---|---|
| 4,482,023 | A * | 11/1984 | Dziedzic et al. | 180/89.17 |
| 4,700,984 | A * | 10/1987 | Kinaga et al. | 296/146.11 |
| 6,175,991 | B1 * | 1/2001 | Driesman et al. | 16/366 |
| 6,336,675 | B1 * | 1/2002 | Bruckner | 296/146.5 |
| 6,619,723 | B2 * | 9/2003 | Duffy | 296/146.11 |
| 6,817,063 | B1 * | 11/2004 | Nania | 16/334 |
| 6,904,643 | B2 * | 6/2005 | Duffy | 16/83 |
| 6,981,295 | B2 * | 1/2006 | Duffy | 16/66 |
| 7,150,492 | B2 * | 12/2006 | Nania | 296/146.12 |
| 7,255,189 | B2 * | 8/2007 | Kurtz et al. | 180/68.4 |
| 7,806,214 | B2 * | 10/2010 | Tsukui et al. | 180/89.17 |
| 8,240,415 | B2 * | 8/2012 | Okada et al. | 180/89.17 |
| 2010/0146860 | A1 * | 6/2010 | Tsukamoto et al. | 49/381 |
| 2010/0301631 | A1 * | 12/2010 | Scott et al. | 296/146.12 |
| 2011/0030279 | A1 * | 2/2011 | Uto | 49/381 |

FOREIGN PATENT DOCUMENTS

| | | | |
|---|---|---|---|
| JP | 09-315347 | A | 12/1997 |
| JP | 2007-126837 | A | 5/2007 |
| JP | 2008-169662 | A | 7/2008 |

* cited by examiner

HINGE AND DOOR UNIT

CROSS REFERENCE TO PRIOR APPLICATIONS

This application is a U.S. National Phase application under 35 U.S.C. §371 of International Application No. PCT/JP2009/059685, filed on May 27, 2009 and claims benefit of priority to Japanese Patent Application No. 2008-224582, filed on Sep. 2, 2008 and Japanese Patent Application No. 2009-002039, filed on Jan. 7, 2009. The International Application was published in Japanese on Mar. 11, 2010 as WO 2010/026806 A1 under PCT Article 21(2). All of these applications are herein incorporated by reference.

TECHNICAL FIELD

The present invention relates to a hinge for mounting a door panel main body to a frame and a door unit which is capable of being opened and closed by the hinge.

BACKGROUND OF THE INVENTION

FIG. 31 illustrates a hydraulic excavator 10, which is a work machine. The hydraulic exactor 10 includes a lower structure 11, an upper structure 12, a cab 13, work equipment 14 and a power system 15 that includes an engine. The cab 13, the work equipment 14 and the power system 15 are mounted on the upper structure 12, which is rotatably mounted on the lower structure 11. The power system 15 is covered by a top cover 16, side doors 17 and others. The side door 17 is mounted by a hinge 18 so as to be capable of opening and closing and secured in an opened state by means of a holding mechanism 19 illustrated in FIGS. 32 to 34.

Regarding the conventional holding mechanism 19 illustrated in FIGS. 32 to 34, when the side door 17 is closed, as illustrated in FIG. 33, the holding mechanism 19 is accommodated by hanging a stay (round bar) 19*s* folded and formed in a U-like shape between holes of brackets 19*a*, 19*b* additionally made on an upper structure frame 12*f*. When the side door 17 is opened, as illustrated in FIG. 34, the stay 19*s* is hooked by hanging the stay 19*s* between the hole of the bracket 19*a* additionally made on the upper structure frame 12*f* and the hole of a bracket 19*d* additionally made on the inner face of the side door 17 (for example, refer to Japanese Laid-open Patent Publication No. 9-315347 (pages 3 to 4, and FIGS. 1 to 4)).

In the above-described conventional holding mechanism 19, it is necessary to additionally install brackets 19*a*, 19*b*, 19*d* by welding for hanging the stay 19*s* on the upper structure frame 12*f* and the side door 17.

Further, the stay 19*s* is simply placed through the holes of the brackets 19*a*, 19*b* when the door is closed. Therefore, there is a concern that the stay 19*s* may come out of the holes of the brackets 19*a*, 19*b* and fall when the machine body is subjected to great vertical vibration. In order to prevent falling, as illustrated in FIGS. 32 to 34, a fall-prevention bracket 19*e* is additionally installed by welding on the inner face of the side door 17, thereby, when the door is closed, the stay 19*s* on the brackets 19*a*, 19*b* is to be pressed from above by the fall-prevention bracket 19*e*.

Still further, in the conventional holding mechanism 19, when the side door 17 is opened, as illustrated in FIG. 34, the stay 19*s* is hooked by hanging the stay 19*s* between the holes of the brackets 19*a*, 19*d*. However, this movement is positioning work accompanied by attachment and detachment of the stay 19*s*, which is troublesome and may be omitted in a work field.

The present invention has been made in view of the above description, and an object of which is to provide a hinge and a door unit which are capable of securing a state where a door is opened without additionally installing brackets on a frame and a door member. Another object of the present invention is to provide a door unit capable of reliably and automatically securing a state where a door is opened with the hinge.

SUMMARY OF THE INVENTION

The invention described is a hinge including a first hinge plate which is fixed to a frame, a second hinge plate which is installed so as to be capable of opening and closing with respect to the first hinge plate to mount a door panel main body, a shaft member for supporting pivotally the second hinge plate so as to be capable of opening and closing with respect to the first hinge plate, and a hinge plate opening-angle restraining mechanism which is installed from the first hinge plate to the second hinge plate to stop the opening movement of the second hinge plate with respect to the first hinge plate at a fixed angle. In this hinge, the hinge plate opening-angle restraining mechanism is provided with a guide plate which is installed integrally at the first hinge plate, a guide hole which is formed in an elongated manner at least in a vertical direction of the guide plate, a receiving plate portion which is installed integrally in a horizontal direction from the guide plate below the guide hole, an engaging hole which is drilled at the receiving plate portion, a guide portion which is continuously slanted downward toward the side opposite from the guide plate via the engaging hole, a bracket portion which is installed integrally in a horizontal direction from the second hinge plate to have a shaft hole, and a hold-stay rod which is installed between the shaft hole of the bracket portion and the guide hole of the guide plate, and the hold-stay rod is provided with a vertical shaft portion which is loosely fitted perpendicularly into the shaft hole of the bracket portion, a horizontal shaft portion which is installed horizontally with respect to the vertical shaft portion and inserted into the guide hole of the guide plate so as to be capable of sliding, and a stopper portion which is formed by folding the leading end of the horizontal shaft portion downward perpendicularly, inserted into the engaging hole by moving from the guide portion to the receiving plate portion due to opening movement of the second hinge plate with respect to the first hinge plate and capable of being taken out from the engaging hole.

The example now described is the hinge according to the above in which the bracket portion is arranged at the end opposite from the side where the shaft member is mounted at the second hinge plate.

The example herein is the hinge in which the guide hole is provided with a vertical hole portion formed in a vertical direction of the guide plate and a horizontal hole portion formed along the receiving plate portion from a lower part of the vertical hole portion toward the first hinge plate.

The hinge according to another example is one in which the guide hole is provided with an oblique hole portion which is formed by obliquely cutting off an inner angle portion between the vertical hole portion and the horizontal hole portion.

In a further example the first hinge plate is provided with a flat plate-like frame contacting plate portion which is in contact with the frame and attached tightly, a bearing plate portion which is folded and formed with respect to the frame contacting plate portion, and a plurality of bearing annular portions which are molded integrally at the bearing plate portion and fitted into the shaft member, the second hinge plate is provided with a panel contacting plate portion for fixing a door panel main body, and a plurality of bearing annular portions which are molded integrally at the panel contacting plate portion and fitted into the shaft member alternately with the bearing annular portions of the first hinge plate, and the first hinge plate is further provided with end portions which are formed by allowing the frame contacting plate portion and the bearing plate portion to protrude from the bearing annular portion of the first hinge plate and that of the second hinge plate in a longitudinal direction.

This example is a door unit including a door panel main body and the hinge in which one side of the door panel main body is mounted to the frame. In the door unit, the door panel main body is provided with an outer panel, an inner panel fixed to the inner surface of the outer panel, and a foamed material filled between the outer panel and the inner panel.

Another invention described is a door unit including a door panel main body and a hinge in which one side of the door panel main body is mounted to a frame. In the door unit, the hinge is provided with a first hinge plate which is fixed to the frame, a second hinge plate which is pivotally supported via a shaft member so as to be capable of opening and closing with respect to the first hinge plate to mount the door panel main body, and a hinge plate opening-angle restraining mechanism which is installed from the first hinge plate to the second hinge plate to stop the opening movement of the second hinge plate with respect to the first hinge plate at a fixed angle, and the hinge plate opening-angle restraining mechanism is provided with a guide plate which is installed on the first hinge plate to have a guide hole formed in an elongated manner in a vertical direction, a pocket portion which has a recessed accommodating portion installed on the guide plate, a guide portion which is installed so as to slant downward toward the outside of the pocket portion from the upper end edge of the pocket portion, a bracket portion which has a horizontal shaft hole made integrally on the second hinge plate, an L-shaped rod which is loosely fitted into the shaft hole of the bracket portion so as to be capable of moving rotationally around a vertical shaft portion and sliding in a vertical direction and which is also fitted into the guide hole of the guide plate so as to be capable of sliding on a horizontal shaft portion, and a stopping plate portion which is installed at the leading end portion of the horizontal shaft portion of the L-shaped rod to move together with the L-shaped rod due to opening movement of the second hinge plate with respect to the first hinge plate, thereby falling into the pocket portion from the guide portion.

Another example is the door unit according to the above in which the guide plate of the hinge plate opening-angle restraining mechanism is formed integrally with the first hinge plate at welded portions by using a plate member different from the first hinge plate, the pocket portion is folded and formed from a lower part of the guide plate, and the guide portion is folded and formed from an upper end edge of the pocket portion.

The invention described below is the door unit in which the guide plate of the hinge plate opening-angle restraining mechanism is molded with a member formed integrally with the first hinge plate, the pocket portion is formed with a member different from the guide plate and welded to the guide plate, and the guide portion is folded and formed from an upper end edge of the pocket portion.

The invention further described is the door unit according to the above in which the first hinge plate is a single hinge plate formed long in a direction of the frame on the side fixed to the frame, the shaft members are a plurality of shaft members whose rotating center axes are arranged on the same straight line along a longitudinal direction at one side portion of one end and that of the opposing end of the first hinge plate in a longitudinal direction, and the second hinge plates are a plurality of hinge plates which are pivotally supported by the shaft members so as to be capable of opening and closing with respect to the first hinge plate.

A further example is the door unit in which the door panel main body is provided with an outer panel, an inner panel fixed to the inner surface of the outer panel, and a foamed material filled between the outer panel and the inner panel.

According to the invention, the hinge plate opening-angle restraining mechanism for stopping the opening movement of the second hinge plate with respect to the first hinge plate at a fixed angle is installed from the first hinge plate to the second hinge plate, and the first and second hinge plates act as brackets of a holding mechanism for securing a door-opening angle installed on a conventional frame and a conventional door. Thereby, there is no need for additionally installing brackets on a frame and a door panel main body, making unnecessary additional components. In particular, in the hold-stay rod, the horizontal shaft portion is always inserted into the guide hole of the guide plate on the first hinge plate, while the vertical shaft portion is kept fitted into the shaft hole of the bracket portion on the second hinge plate and is not removed. Therefore, no additional components are needed to prevent falling on occurrence of great vibration when a door is closed. Further, when the door is opened, the stopper portion installed at the leading end portion of the hold-stay rod moves together with the hold-stay rod and falls into an engaging hole so as to smoothly ride over the receiving plate portion from the guide portion. Thereby, fixing functions are automatically activated in association with movement of fully opening the door, making it possible to automatically secure a door-opened state at a fully opened angle. At this time, the stopper portion formed by folding downward perpendicularly the leading end of the horizontal shaft portion of the hold-stay rod is allowed to fall into the engaging hole and fixed. Therefore, as long as the stopper portion is not pulled out by operation, the stopper portion will not come off from the engaging hole. It is, thereby, possible to reliably secure a state where the door panel main body is opened. Further, in the above-described constitution, components can be downsized as compared with a conventional holding mechanism, by which the components can be kept compact within the hinge. Still further, the vertical shaft portion of the hold-stay rod is loosely fitted into the shaft hole of the bracket portion installed integrally at the second hinge plate. Thereby, the hinge plate opening-angle restraining mechanism can be made simple in structure to attain a cost reduction and easy change in strength on the basis of an easily attachable and detachable structure of the hold-stay rod.

Accordingly, the bracket portion is arranged at the end opposite from the side where the shaft member is mounted at the second hinge plate, and the vertical shaft portion of the hold-stay rod is loosely fitted into the shaft hole of the bracket portion. Therefore, the vertical shaft portion of the hold-stay rod is arranged at a site most distant from the shaft member, thus making it possible to improve a supporting force of the hold-stay rod against a force which will close the door panel main body.

Further, the guide hole is provided with a horizontal hole portion formed along the receiving plate portion from a lower part of the vertical hole portion formed on the guide plate in a vertical direction toward the first hinge plate. Therefore, the horizontal shaft portion of the hold-stay rod is capable of smoothly coping with a change in horizontal angle when sliding axially inside the guide hole, thus making it possible to ensure the smooth activation of the hold-stay rod. In particular, after the start of door-closing movement at the time of closing the door, the horizontal shaft portion is more likely to sway to the first hinge plate. However, the horizontal hole portion will not prevent the sway of the horizontal shaft portion, thus making it possible to ensure smooth activation of the hold-stay rod.

Also, an oblique hole portion is formed by obliquely cutting off an inner angle portion between the vertical hole portion and the horizontal hole portion of the guide hole. Therefore, when the stopper portion of the hold-stay rod descends along the guide portion while sliding on the receiving plate portion and the guide portion in a horizontal direction, the horizontal shaft portion of the hold-stay rod is capable of smoothly descending along the oblique hole portion while moving in the horizontal direction.

Further more, there is a concern that at a processing stage where the frame contacting plate portion and the bearing plate portion in the first hinge plate are folded and formed, there may be found a decrease in strength along a folded line between the frame contacting plate portion and the bearing plate portion. Since the leading end of the folded line is in particular vulnerable to loads acting directly from the side thereof, the frame contacting plate portion and the bearing plate portion in the first hinge plate are allowed to protrude in a longitudinal direction from the bearing annular portions fitted into the shaft member, thereby forming end portions. And, the leading end of the folded line is positioned so as to be distant, thereby distributing stress when loads of the door panel main body act on the first hinge plate from the second hinge plate by way of the shaft member and the bearing annular portions. Thereby, load stress acting on the leading end of the folded line is lowered to reduce the concentration of the stress at the leading end, thus making it possible to improve the durability of the leading end portion of the folded line.

In an example, the foamed material is filled between the outer panel and the inner panel, thereby attaining a reduction in weight of the door panel main body and improvement of vibration absorption performance. Thus, it is possible to reduce loads acting on the hinge and also improve the durability of the hinge.

According to another example of the invention, the hinge plate opening-angle restraining mechanism for stopping the opening movement of the second hinge plate with respect to the first hinge plate at a fixed angle is installed from the first hinge plate to the second hinge plate. In other words, the first and second hinge plates act as brackets of a holding mechanism for securing a door-opening angle installed on a conventional frame and a conventional door. Thus, there is no need for additionally installing brackets on a frame and a door panel main body, thereby making unnecessary additional components. In particular, in the L-shaped rod, the horizontal shaft portion is always fitted into the guide hole of the guide plate on the first hinge plate, while the vertical shaft portion is kept loosely fitted into the shaft hole of the bracket portion on the second hinge plate and is not removed. Therefore, no additional components are needed to prevent falling on occurrence of great vibration when a door is closed. Further, when the door is opened, the stopper plate portion installed at the leading end portion of the L-shaped rod moves together with the L-shaped rod and falls into a pocket portion so as to ride over the guide portion. Thereby, fixing functions are automatically activated in association with movement of fully opening the door, making it possible to automatically secure a door-opened state at a fully opened angle. Further, according to the above-described constitution, components can be downsized as compared with a conventional holding mechanism, by which the components can be kept compact within the hinge. Still further, the vertical shaft portion of the L-shaped rod is loosely fitted into the hole of the bracket portion installed integrally at the second hinge plate so as to be capable of moving rotationally and sliding in a vertical direction, by which the hinge plate opening-angle restraining mechanism can be made simple in structure to attain a cost reduction and easy change in strength on the basis of an easily attachable and detachable structure of the L-shaped rod.

According to the invention, the guide plate can have the pocket portion and the guide portion which have been sequentially folded and formed is welded to the first hinge plate, by which the hinge plate opening-angle restraining mechanism can be easily manufactured to reduce costs.

According to another example, the pocket portion formed with a different member is welded to the guide plate molded with a member formed integrally with the first hinge plate. Therefore, it is possible to mount later the pocket portion, the shape of which is difficult to manufacture by integral molding with the guide plate.

In another example, a plurality of second hinge plates are supported pivotally with a plurality of shaft members arranged on the same straight line so as to be capable of opening and closing with respect to the long first hinge plate, thereby integrating two hinges into one hinge. No reciprocal adjustment is needed between these two hinges, thus making it possible to easily and finely adjust a state where a door is mounted. The number of mounting bolts can also be decreased. Thus, it is possible to improve the mounting workability by using the hinge and also easily and finely adjust a state where the door is mounted. Further, since the long first hinge plate acts as a plate for integrating a plurality of hinges, it is not necessary to weld a plate between a plurality of hinges for integrating a plurality of hinges. Thus, unlike welded hinges, it is possible to omit a welding process and also improve the rigidity of the hinge.

Further more, the foamed material can be filled between the outer panel and the inner panel, thereby attaining a reduction in weight of the door panel main body and improvement of the vibration absorbing performance. Thus, it is possible to reduce loads acting on the hinges and also improve the durability of the hinges.

DETAILED DESCRIPTION OF THE INVENTION

Hereinafter, the present invention will be described in detail by referring to an example illustrated in FIGS. 1 to 11, another example illustrated in FIGS. 12 to 16, a further example illustrated in FIG. 17, an additional example illustrated in FIGS. 18 to 28, the next example illustrated in FIG. 29, and an example illustrated in FIG. 30.

First, description will be made for the example illustrated in FIGS. 1 to 11.

Figure 7:
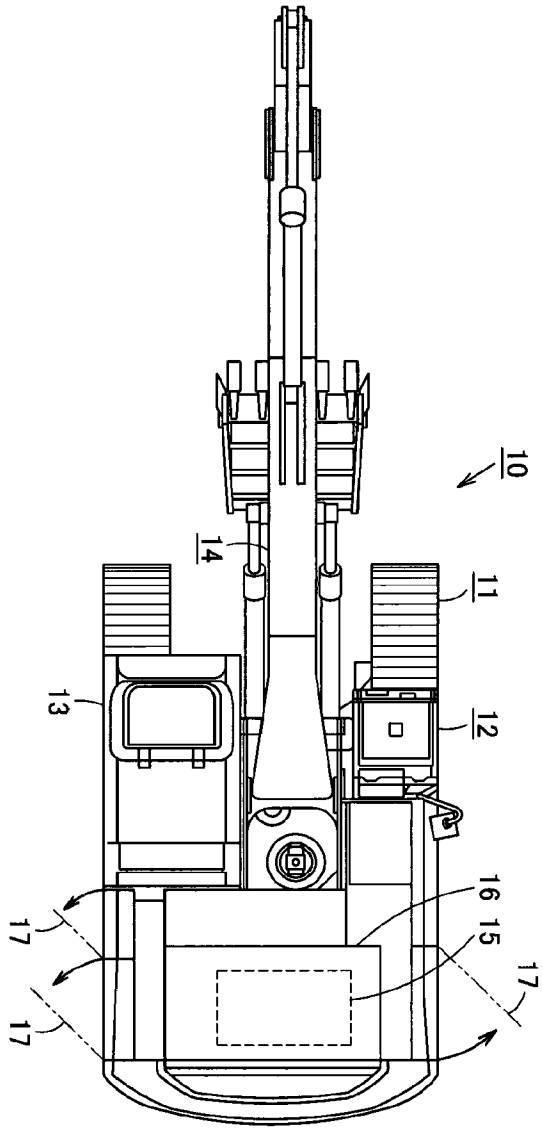
FIG. 7 is a plan view of a work machine provided with the above-described door unit.

FIG. 7 illustrates a hydraulic excavator 10, which is a work machine. The hydraulic exactor 10 includes a lower structure 11, an upper structure 12, a cab 13, work equipment 14, and a power system 15 that includes an engine. The cab 13, the work equipment 14, and the power system 15 are mounted on the upper structure 12, which is rotatably mounted on the lower structure 11. The power system 15 is covered by a top cover 16, side doors 17 and others.

Figure 8:
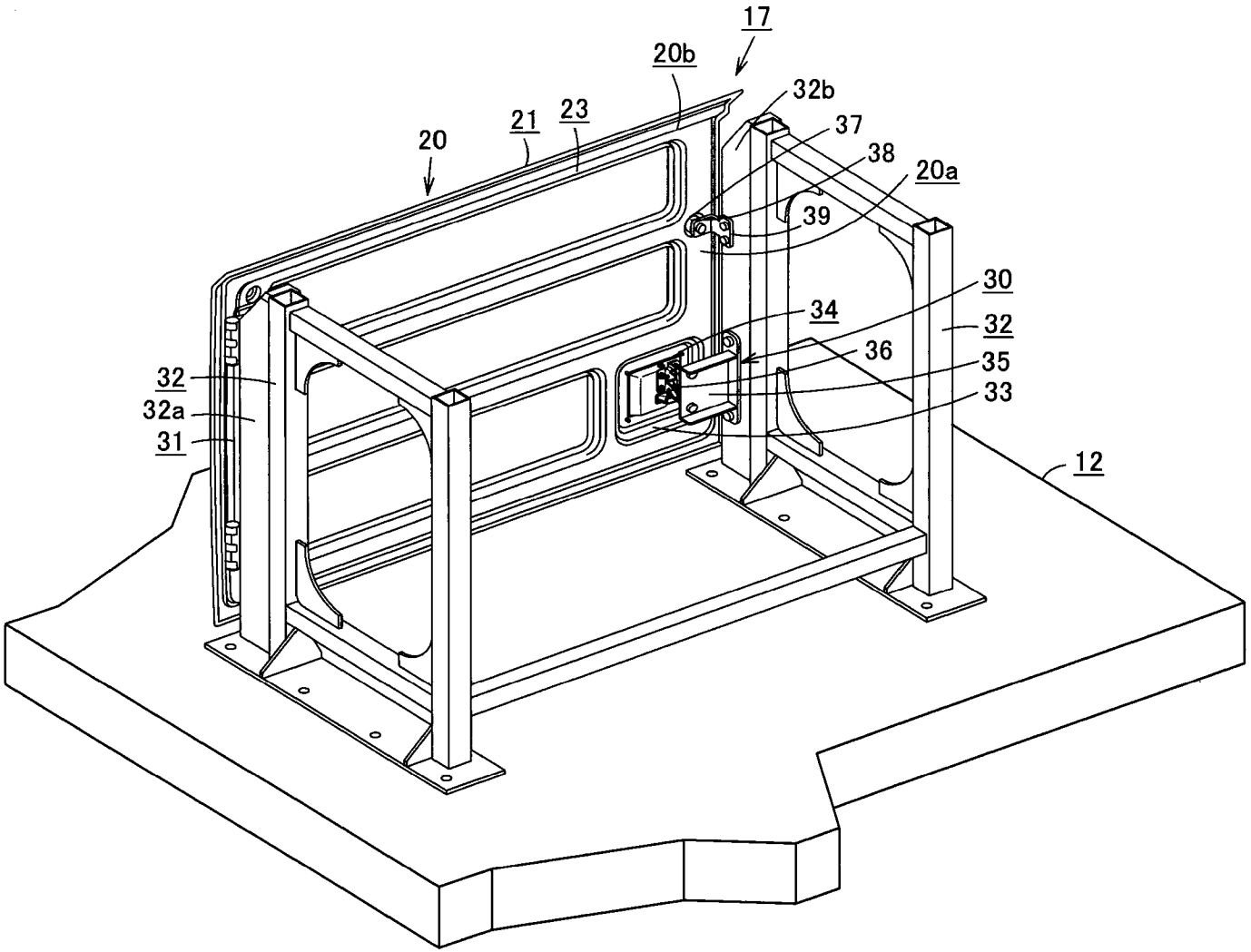
FIG. 8 is a perspective view of the door unit, when viewed from inside.

As illustrated in FIG. 8, one side of a door panel main body 20 of the side door 17 is mounted to a frame 32 on the machine body which is installed on the upper structure 12 by means of a hinge 31 mounted to one side portion of the door panel main body 20. In other words, one side portion of the door panel main body 20 is mounted to a first side member 32*a* of the frame 32 by means of the hinge 31 so as to be capable of opening and closing in a horizontal direction. The door panel main body 20 is folded at the upper part thereof to the frame 32 side with respect to a perpendicular surface portion 20*a*, thereby giving a folded surface portion 20*b*.

A latching mechanism portion 34 of a latching device 30 by which the perpendicular surface portion 20*a* of the door panel main body 20 can be engaged or disengaged with the frame 32 is installed at a latch mounting hole portion 33 opposite from the hinge 31 of the door panel main body 20. On the other hand, in association with opening and closing of the door panel main body 20, a striker 36 is installed in a protruding manner as an engaging member of the latching device 30 from an mounting plate 35 fixed to a second side member 32*b* of the frame 32 in opposition to a direction at which the door panel main body 20 is in contact. Thereby, the latching mechanism portion 34 installed on the door panel main body 20 is capable of being engaged or disengaged with the striker 36.

A vibration-damping engaging portion 37 obtained by forming the inner panel 23 of the door panel main body 20 in a recessed shape is installed above the latching mechanism portion 34. On the other hand, a vibration-damping plunger capable of being engaged or disengaged with the vibration-damping engaging portion 37 in association with opening and closing of the door panel main body 20 is mounted via a mounting plate 39 to the second side member 32*b* of the frame 32 on the machine body.

Figure 9:
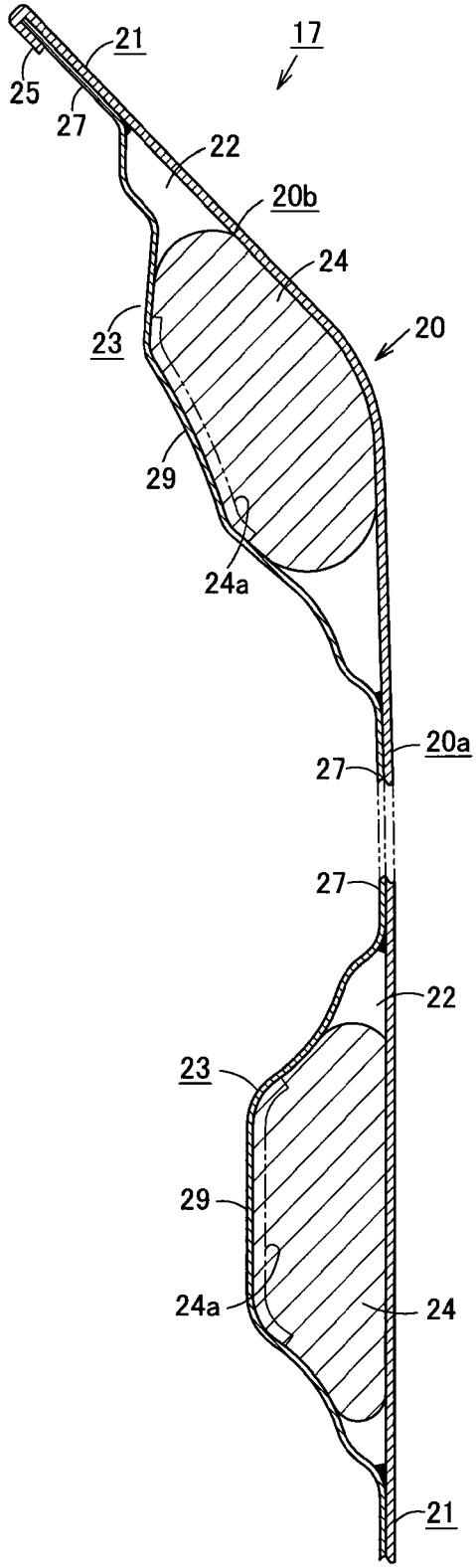
FIG. 9 is a sectional view of a door panel main body of the door unit.

FIG. 9 illustrates the door panel main body 20 of the side door 17. The door panel main body 20 includes an outer panel 21, an inner panel 23 and a foamed material 24. The inner panel 23 is formed with a plate metal thinner in thickness than the outer panel 21 by means of press molding so as to have an uneven surface with recessed portions and raised portions. The recessed portions are fixed to the inner surface of the outer panel 21 and a space 22 is formed between the raised portions and the outer panel 21. The foamed material 24 is filled in the space 22 between the outer panel 21 and the inner panel 23. The foamed material 24 is foamed by heating a foaming material 24*a*.

A peripheral edge of the outer panel 21 has a hemmed portion 25 that is hemmed by folding the peripheral edge of the outer panel 21 so as to curl over the peripheral edge of the inner panel 23 and then pressing down the folded part. The inner panel 23 is provided with recessed portions 27 formed in a recessed shape and bonded to the outer panel 21 by using an adhesive and raised portions 29 molded in a protruding manner with respect to these recessed portions 27. The adhesive may desirably be a paste-type structural adhesive having both viscous and thermosetting properties because the outer panel 21 and the inner panel 23 are bonded together and sealed.

Figure 10:
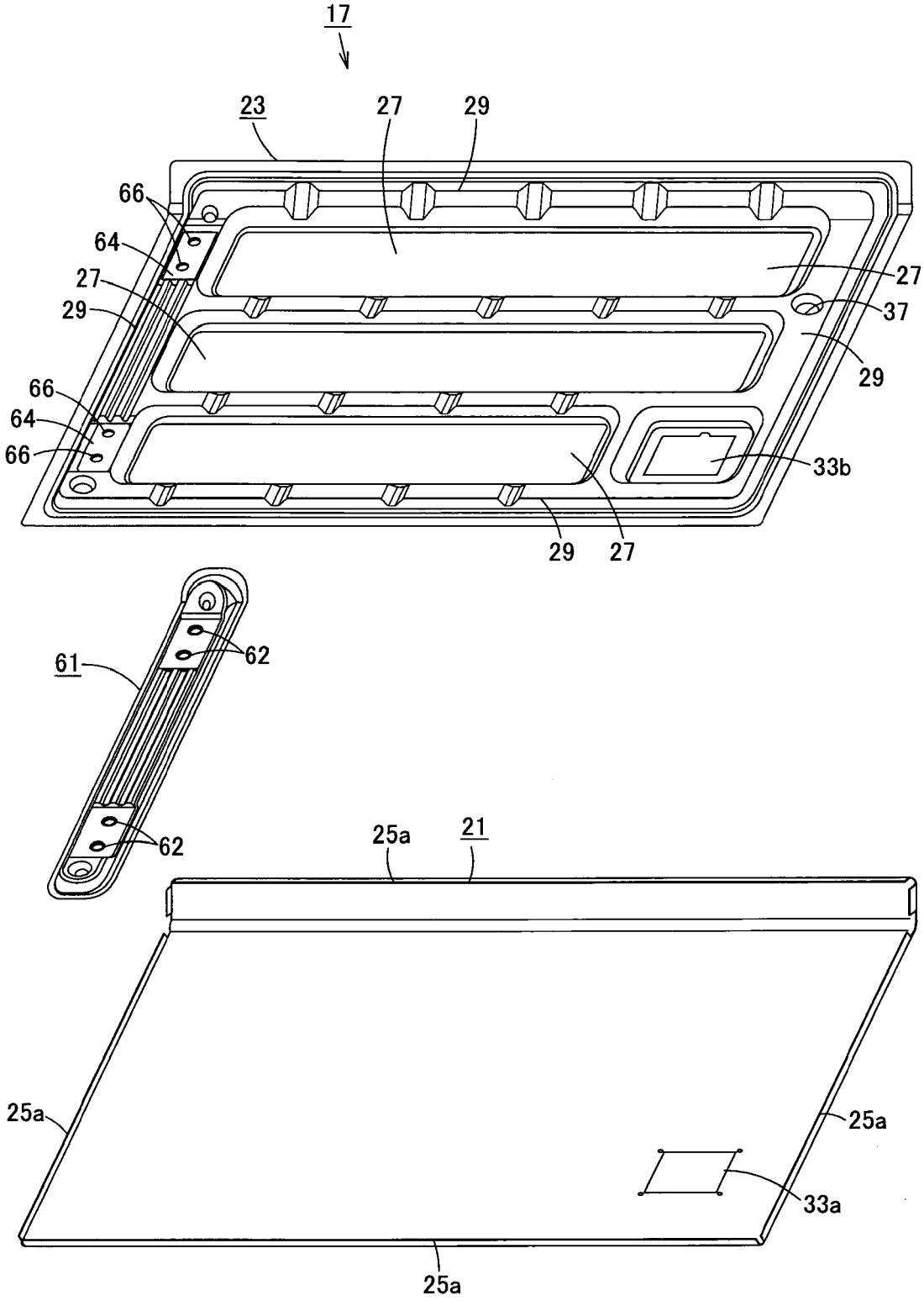
FIG. 10 is an exploded perspective view of the door panel main body of the door unit.
Figure 11:
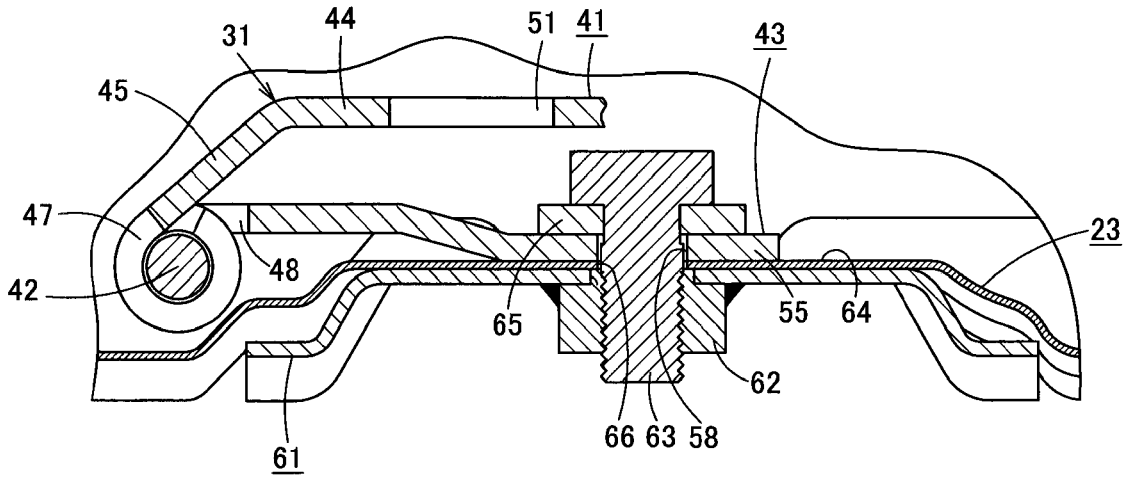
FIG. 11 is a sectional view of a hinge mounting portion of the door unit.
Figure 12:
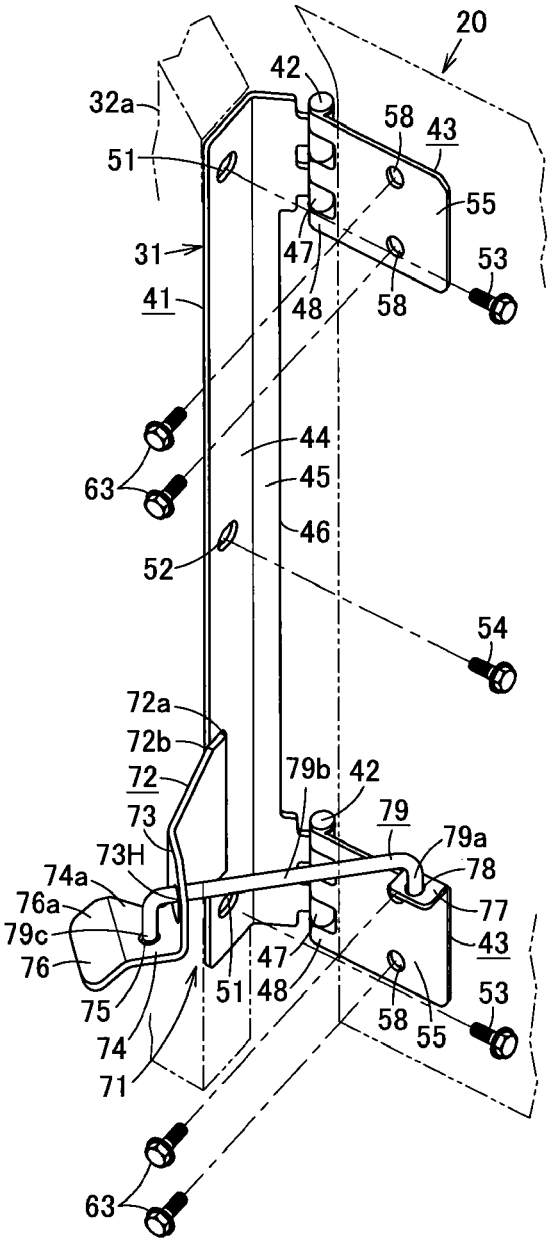
FIG. 12 is a perspective view illustrating a second embodiment of the hinge used in the door unit of the present invention when a door is opened.
Figure 13:
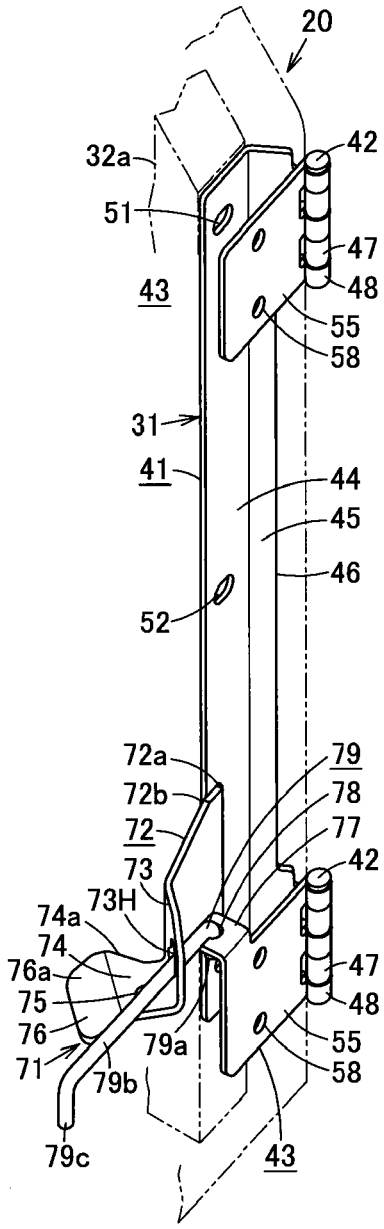
FIG. 13 is a perspective view of the hinge when the door is closed.

FIGS. 10 and 11 illustrate a structure of mounting the hinge 31 to the door panel main body 20. As illustrated in FIG. 10, an internal reinforcing plate 61 is adhered between one side portion of the outer panel 21 and that of the inner panel 23. Then, nuts 62 welded on the reverse surface of the internal reinforcing plate 61 and bolts 63 to be screwed into these nuts 62 as illustrated in FIG. 11 are used to mount the hinge 31 positioned on a hinge mounting surface portion 64 of the inner panel 23. A washer 65 is interposed between the hinge 31 and the head of the bolt 63.

Then, the bolt 63 which is inserted through the washer 65 into a bolt insertion hole 58 of the hinge 31 and a bolt insertion hole 66 drilled at the hinge mounting surface portion 64 of the inner panel 23 is screwed into the nut 62 formed integrally on the reverse surface of the internal reinforcing plate 61, thereby mounting the hinge 31.

In FIG. 10, the peripheral edge 25*a* of the outer panel 21 is folded so that the peripheral edge of the inner panel 23 can be attached by fitting. However, the peripheral edge 25*a* of the outer panel 21 is folded and the folded part is pressed down, thereby giving the hemmed portion 25. Further, as illustrated in FIG. 10, the latching mechanism portion 34 is loaded on a latch mounting hole portion 33*a* of the outer panel 21 and a latch mounting hole portion 33*b* of the inner panel 23.

FIGS. 1 to 6 illustrate structures of the hinge 31. The hinge 31 is provided with a single first hinge plate 41 formed long on the side fixed to the first side member 32*a* of the frame 32 on the machine body in a direction of the frame, a plurality of shaft members 42 whose rotating center axes are arranged on the same straight line along a longitudinal direction at one side portion of one end and that of the opposing end of the first hinge plate 41 in a longitudinal direction, and a plurality of second hinge plates 43 supported pivotally by the shaft members 42 so as to be capable of opening and closing with respect to the first hinge plate 41 to mount the door panel main body 20.

In the first hinge plate 41, a bearing plate portion 45 is folded and formed with respect to a flat plate-like frame contacting plate portion 44, and a plurality of bearing annular portions 47 molded integrally at one end and at the opposing end and a plurality of bearing annular portions 48 integrally molded individually at a plurality of second hinge plates 43 are alternately fitted via a center notch 46 of the bearing plate portion 45, thereby the shaft member 42 is inserted into the bearing annular portions thereof.

Figure 1:
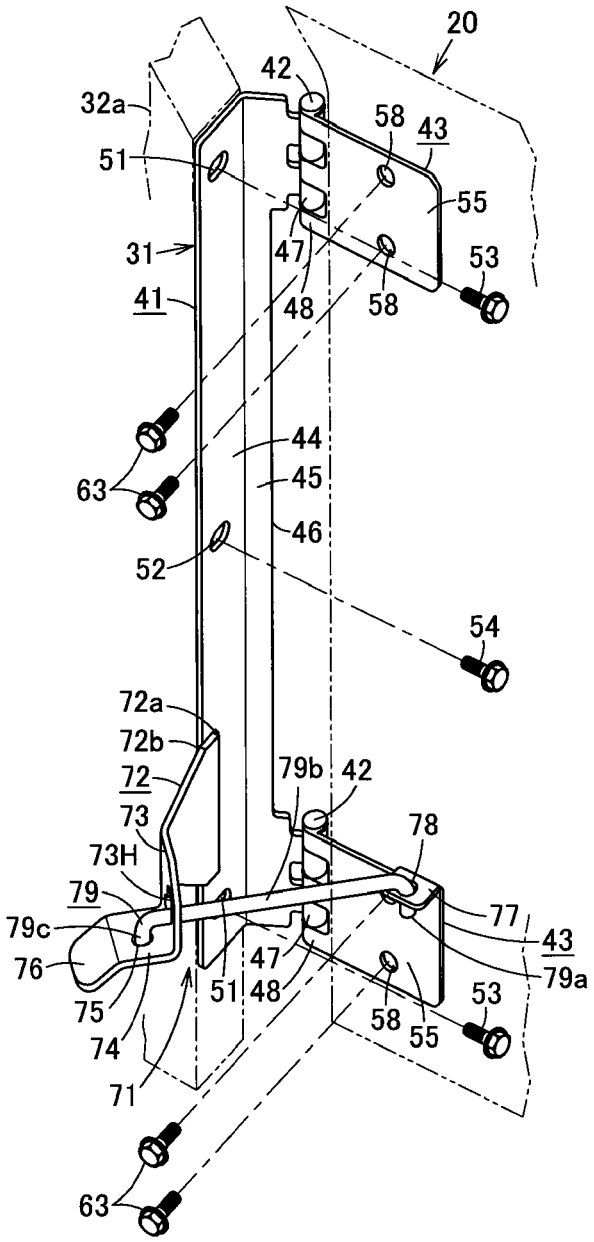
FIG. 1 is a perspective view illustrating a first embodiment of a hinge used in a door unit of the present invention when a door is opened.
Figure 2:
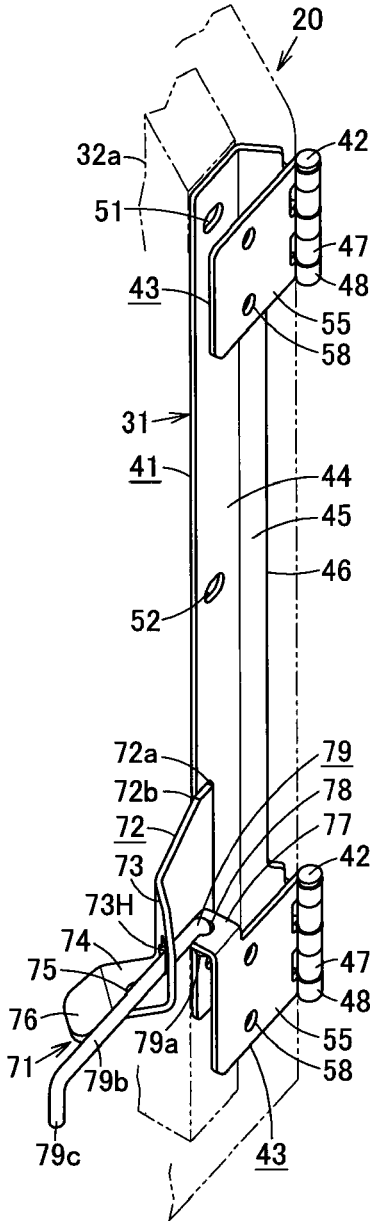
FIG. 2 is a perspective view of the hinge when the door is closed.

Elongated holes for tightening-bolt insertion 51, 52, 51 are drilled at one end, a center part and the opposing end in the frame contacting plate portion 44 of the first hinge plate 41. As illustrated in FIG. 1, the frame contacting plate portion 44 can be fixed to the first side member 32*a* of the frame 32 on the machine body and can also be loosened by using tightening bolts 53, 54, 53 inserted into the elongated holes 51, 52, 51.

Further, as illustrated in FIG. 11, in the upper and lower second hinge plates 43, a panel contacting plate portion 55 is molded integrally at the bearing annular portion 48, and a bolt insertion hole 58 for fixing the door panel main body 20 is drilled at the panel contacting plate portion 55.

When the hinge 31 mounted to the side door 17 as described above is used to mount the side door 17 to the frame 32 on the machine body, as illustrated in FIG. 1, tightening bolts 53, 54, 53 which have been inserted into elongated holes 51, 52, 51 on the first hinge plate 41 are screwed into nut members installed on the first side member 32*a* of the frame 32 and attached tightly. In this instance, in a state where the tightening bolts 53, 54, 53 are loosened, the door panel main body 20 is allowed to move in a range where these tightening bolts 53, 54, 53 are capable of moving inside the elongated holes 51, 52, 51, thereby making a fine adjustment for a position at which the door panel main body 20 is mounted.

As illustrated in FIGS. 1 to 5, from the first hinge plate 41 to the second hinge plate 43, there is provided a hinge plate opening-angle restraining mechanism 71 for stopping the opening movement of the second hinge plate 43 with respect to the first hinge plate 41 at a fixed angle.

In the hinge plate opening-angle restraining mechanism 71, the base end of a guide plate 72 constituted with a plate member different from the first hinge plate 41 is integrally mounted to the first hinge plate 41 at an inner welded portion 72*a* and an outer welded portion 72*b*. Further, a rod insertion plate portion 73 is integrally folded and formed on the guide plate 72, a guide hole 73H is formed at the rod insertion plate portion 73 in an elongated manner at least in a vertical direction, a receiving plate portion 74 is integrally folded and formed from a lower part of the rod insertion plate portion 73 in a horizontal direction, an engaging hole 75 is drilled at the receiving plate portion 74, and a guide portion 76 is continuously slanted downward toward the side opposite from the rod insertion plate portion 73 via the engaging hole 75.

Further, in the hinge plate opening-angle restraining mechanism 71, an integrally molded bracket portion 77 is installed at the upper edge of the end opposite from the side where the shaft member 42 is mounted at the lower second hinge plate 43 so as to be folded horizontally to the guide plate 72 side. And, a vertical shaft portion 79*a* of the hold-stay rod 79 is loosely fitted into the shaft hole 78 of the bracket portion 77 so as to be capable of moving rotationally perpendicularly and also sliding in a vertical direction.

A horizontal shaft portion 79*b* installed horizontally with respect to the vertical shaft portion 79*a* of the hold-stay rod 79 is inserted into the guide hole 73H of the guide plate 72 so as to be capable of sliding. A stopper portion 79*c* is inserted into the engaging hole 75 by movement from the guide portion 76 to the receiving plate portion 74 due to opening movement of the second hinge plate 43 with respect to the first hinge plate 41 and can be taken out from the engaging hole 75 by pushing-up operation with the tip of the finger. And, the stopper portion 79*c* is formed at the leading end of the horizontal shaft portion 79*b* so as to be folded downward perpendicularly.

Figure 4:
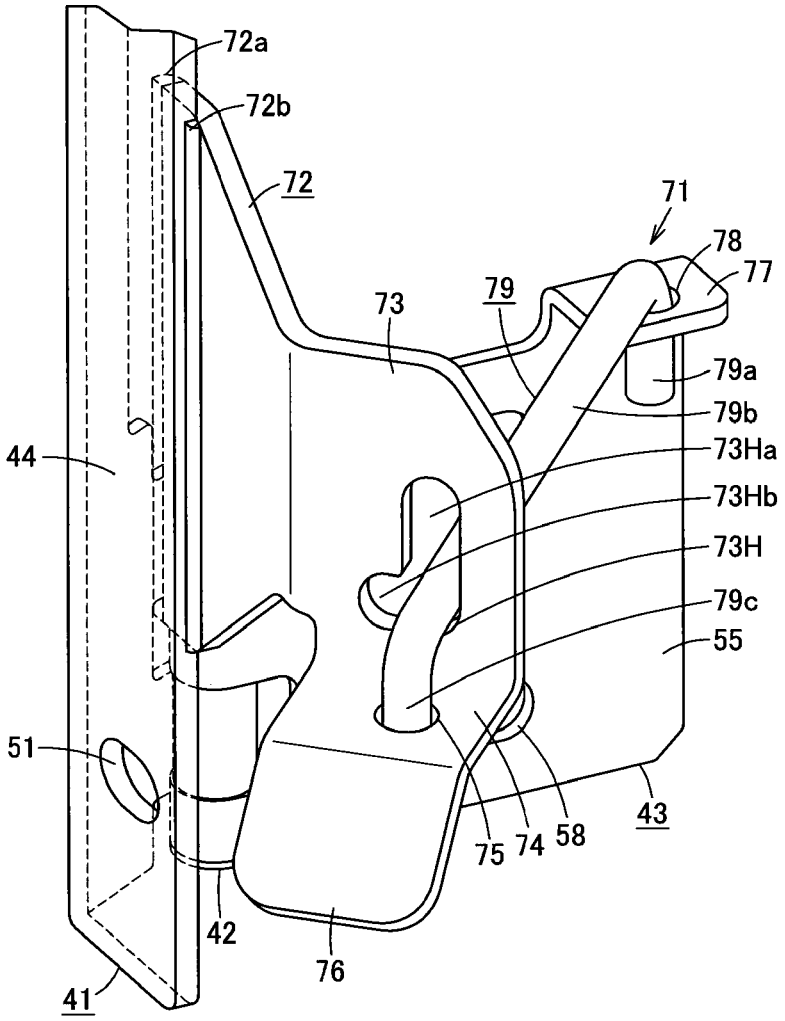
FIG. 4 is a perspective view taken from the other direction illustrating major parts of the hinge.

As illustrated in FIG. 4, the guide hole 73H of the guide plate 72 is provided with a vertical hole portion 73Ha formed at the rod insertion plate portion 73 in a vertical direction and a horizontal hole portion 73Hb formed along the receiving plate portion 74 from a lower part of the vertical hole portion 73Ha toward the first hinge plate 41.

Next, description will be made for actions and effects of the example illustrated in FIGS. 1 to 11.

Figure 6:
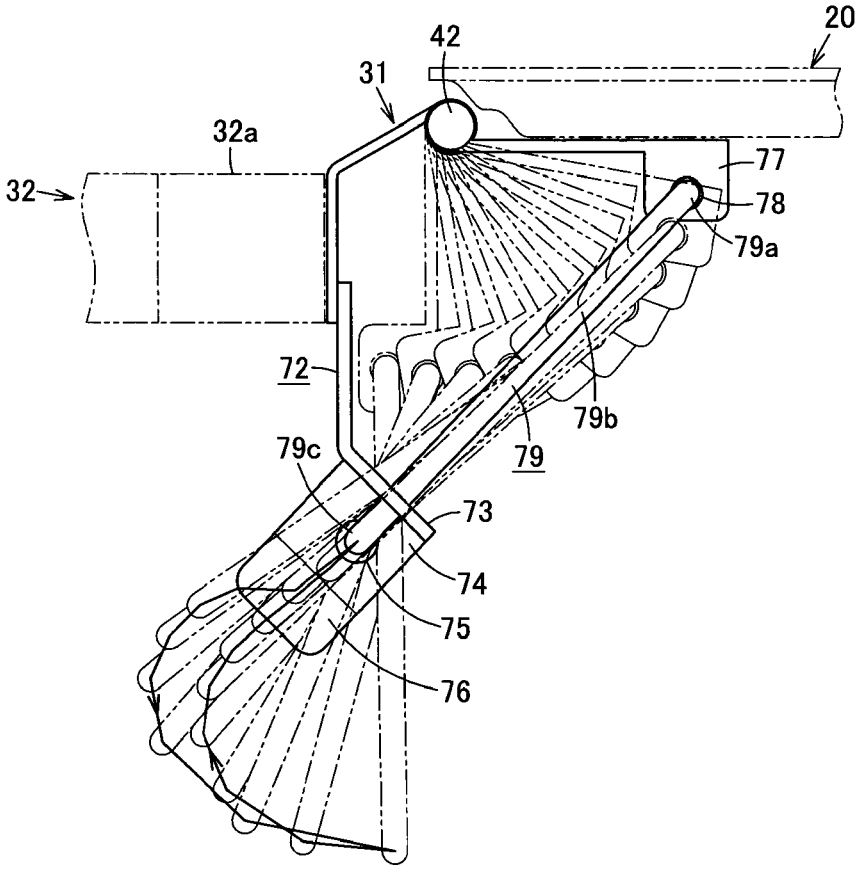
FIG. 6 is a plan view illustrating operating trajectories of the hinge.

FIG. 6 illustrates a series of movements by the hinge 31 when the door panel main body 20 is opened and closed. As illustrated in FIG. 6, at a stage where the door panel main body 20 is opened, the hold-stay rod 79 which is kept inserted into the guide hole 73H of the guide plate 72 rises and slides, with the stopper portion 79*c* being pushed up by the guide portion 76, while moving rotationally in a horizontal direction on the basis of the vertical shaft portion 79*a* inserted into the shaft hole 78 of the bracket portion 77, thereby moving on the receiving plate portion 74.

Figure 3:
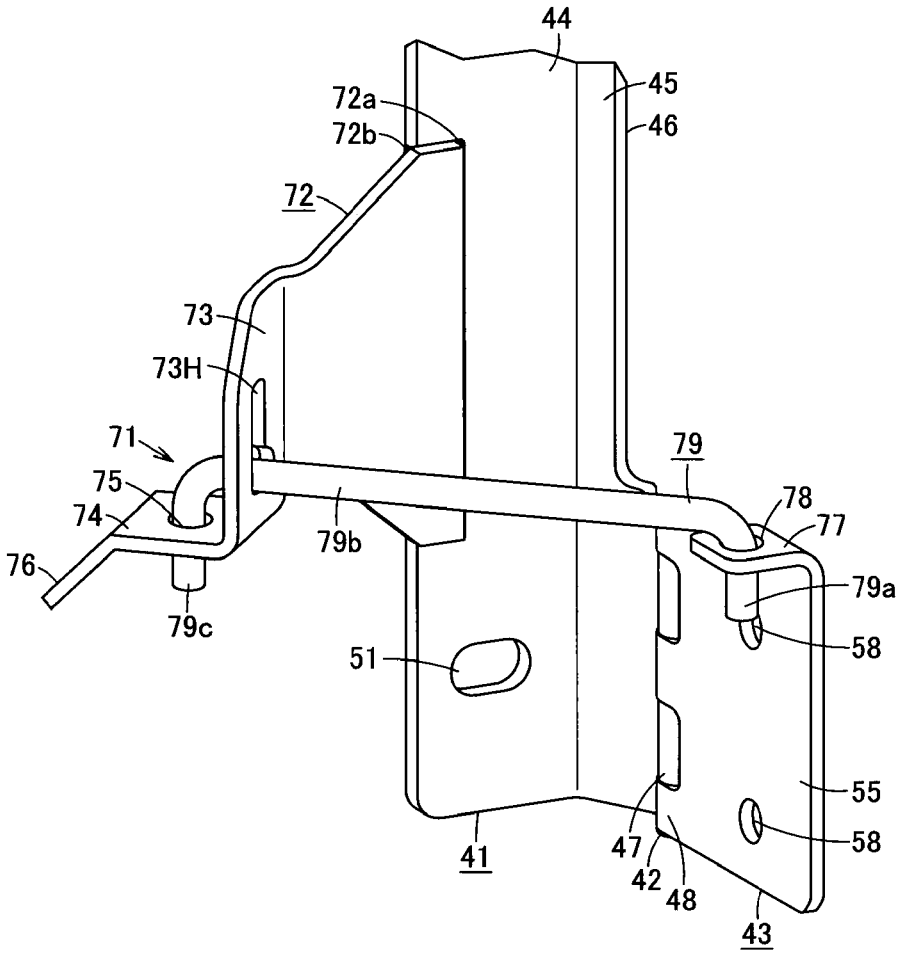
FIG. 3 is a perspective view taken from one direction illustrating major parts of the hinge.
Figure 5:
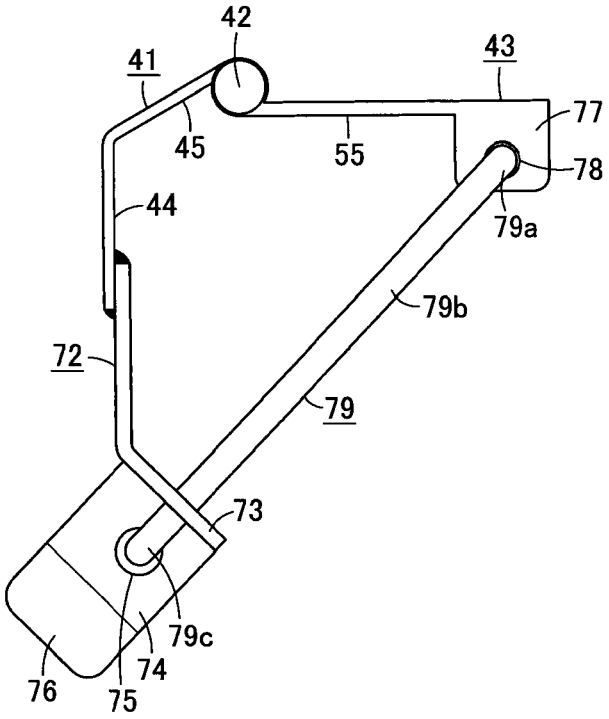
FIG. 5 is a plan view of the hinge.

Then, as illustrated in FIGS. 3 to 5, in a state where the door panel main body 20 is fully opened, the stopper portion 79*c* of the hold-stay rod 79 which has climbed up a gradient of the guide portion 76 falls into the engaging hole 75 of the receiving plate portion 74. Thereby, the hold-stay rod 79 is restricted in movement with respect to the first hinge plate 41, making it possible to lock the opening and closing movement of the second hinge plate 43 by means of the hold-stay rod 79. In other words, it is possible to lock the opening and closing movement of the door panel main body 20 mounted to the second hinge plate 43.

When locking actions are released in the fully opened state, the stopper portion 79*c* of the hold-stay rod 79 is pushed up along the vertical hole portion 73Ha to take out the stopper portion 79*c* from the engaging hole 75. Then, the locked state is released, thereby allowing the second hinge plate 43 to move toward a closing direction. In other words, it is possible to close the door panel main body 20 mounted to the second hinge plate 43.

When the hinge 31 is closed together with the door panel main body 20, as illustrated in FIG. 6, the stopper portion 79*c* of the hold-stay rod 79 is capable of sliding so as to descend along the guide portion 76 and also move rotationally in a horizontal direction. At this time, the horizontal shaft portion 79*b* of the hold-stay rod 79 is capable of descending along the vertical hole portion 73Ha and moving along the horizontal hole portion 73Hb in the horizontal direction as well.

Therefore, it is possible to smoothly cope with a change in horizontal angle upon axial sliding of the horizontal shaft portion 79*b* of the hold-stay rod 79 inside the guide hole 73H and also ensure smooth activation of the hold-stay rod 79. In particular, after the start of door-closing movement at the time of closing the door, the horizontal shaft portion 79*b* is more likely to sway to the first hinge plate 41. However, the horizontal hole portion 73Hb will not prevent the sway of the horizontal shaft portion 79*b*, thus making it possible to ensure smooth activation of the hold-stay rod 79.

Further, when the door panel main body 20 is closed, as illustrated in FIG. 8, the latching mechanism portion 34 of the door panel main body 20 moves toward the striker 36 protruded from the second side member 32*b* of the frame 32 and is restricted and stopped by a hook of the striker 36. At the same time, the vibration-damping plunger 38 installed on the frame 32 is fitted into the recessed vibration-damping engaging portion 37 installed at a perpendicular surface portion 20*a* of the door panel main body 20, thereby restraining vertical vibration of the door panel main body 20.

As illustrated in FIG. 9, the door panel main body 20 can attain a reduction in weight by adopting a hollow closed-cross-section structure formed with the outer panel 21 and the inner panel 23 thinner than the outer panel 21. The strong door panel main body 20 capable of securing strength sufficient to bear external impact can also be provided at reasonable cost by adopting a sufficiently-high and hollow closed-cross-section structure formed with the inner panel 23 and the outer panel 21 thicker than the inner panel 23. Further, the foamed material 24 filled between the outer panel 21 and the inner panel 23 is capable of effectively damping sounds resulting from the door panel main body 20 in itself. Therefore, it is possible to effectively attain a reduction in ambient noise.

Figure 32:
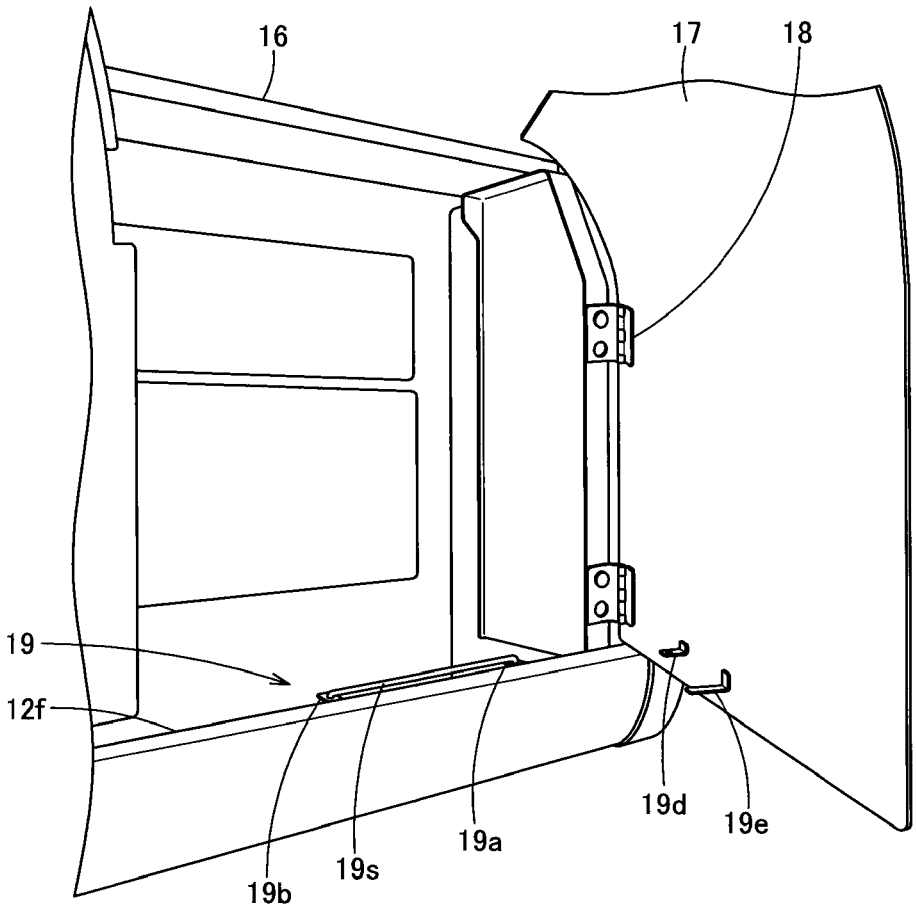
FIG. 32 is a perspective view illustrating the conventional door unit in a state where a door is opened.
Figure 33:
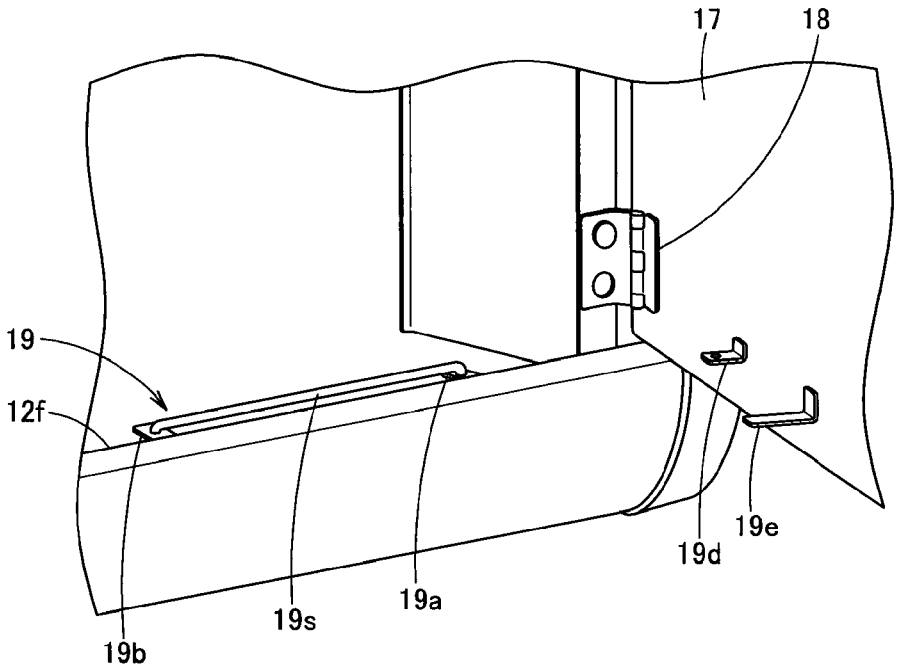
FIG. 33 is a perspective view illustrating a conventional holding mechanism when accommodated.
Figure 34:
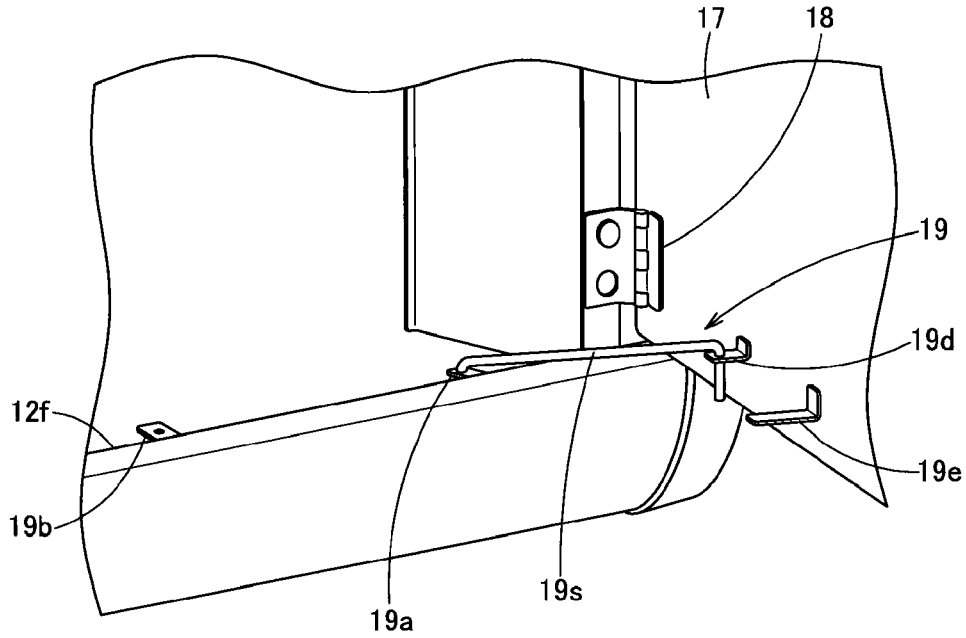
FIG. 34 is a perspective view illustrating the conventional holding mechanism when used.

Further, the hinge plate opening-angle restraining mechanism 71 for stopping the opening movement of the second hinge plate 43 with respect to the first hinge plate 41 at a fixed angle is installed from the first hinge plate 41 to the second hinge plate 43. In other words, the first and second hinge plates 41, 43 act as brackets 19*a*, 19*b*, 19*d* (refer to FIGS. 32 to 34) of the holding mechanism 19 installed on a conventional frame and a conventional door, thereby eliminating the need for additionally installing brackets on the frame 32 and the door panel main body 20 in the machine body. It is, thus, possible to make unnecessary additional components and a welding process thereof.

In particular, in the hold-stay rod 79, the horizontal shaft portion 79*b* is always inserted into the guide hole 73H of the guide plate 72 of the first hinge plate 41, while the vertical shaft portion 79*a* is kept fitted into the shaft hole 78 of the bracket portion 77 of the second hinge plate 43 and is not removed. Therefore, even when great vibration occurs at the time of closing a door (at the time of working), no additional components are needed to prevent falling. Further, at the time of opening the door, the stopper portion 79*c* installed at the leading end portion of the hold-stay rod 79 moves together with the hold-stay rod 79 and falls into the engaging hole 75 so as to smoothly ride over the receiving plate portion 74 from the guide portion 76. Thus, in association with the movement of fully opening the door, fixing functions can be automatically activated to automatically secure a state where the door panel main body 20 is opened at a fully opened angle.

In this instance, the stopper portion 79*c* formed by folding downward perpendicularly the leading end of the horizontal shaft portion 79*b* of the hold-stay rod 79 falls into the engaging hole 75 and is fixed. Therefore, as long as the stopper portion 79*c* is not pulled out by operation, the stopper portion 79*c* will not come off from the engaging hole 75. It is, thereby, possible to reliably secure a state where the door panel main body 20 is opened.

Further, according to the above-described constitution, components can be downsized as compared with a conventional holding mechanism 19, by which the components can be kept compact within the hinge 31. Still further, the vertical shaft portion 79*a* of the hold-stay rod 79 is loosely fitted into the shaft hole 78 of the bracket portion 77 installed integrally at the second hinge plate 43. Thereby, the hinge plate opening-angle restraining mechanism 71 can be made simple in structure to attain a cost reduction and easy change in strength on the basis of an easily attachable and detachable structure of the hold-stay rod 79.

Further, the bracket portion 77 is arranged at the end opposite from the side where the shaft member 42 is mounted at the second hinge plate 43, thereby the vertical shaft portion 79*b* of the hold-stay rod 79 is loosely fitted into the shaft hole 78 of the bracket portion 77. Thus, the vertical shaft portion 79*a* of the hold-stay rod 79 is arranged at a site most distant from the shaft member 42, making it possible to improve a supporting force of the hold-stay rod 79 against a force which will close the door panel main body 20.

Still further, since the guide plate 72 having the engaging hole 75 and the guide portion 76 which have been sequentially folded and formed is welded to the first hinge plate 41, it is possible to easily manufacture the hinge plate opening-angle restraining mechanism 71 and reduce costs.

In addition, a plurality of second hinge plates 43 are supported pivotally on the long first hinge plate 41 by using a plurality of shaft members 42 arranged on the same straight line so as to be capable of opening and closing, thereby integrating two hinges into one hinge. Therefore, no reciprocal adjustment is needed between these two hinges, thus making it possible to easily and finely adjust a state where the door is mounted. The first hinge plate 41 can be mounted to the frame 32 with three tightening bolts 53, 54, 53, thereby reducing the number of mounting bolts. It is possible to improve the mounting workability by using the hinge 31 and also easily and finely adjust a state where the door is mounted.

In particular, when the door panel main body 20 is allowed to move so as to move rotationally around the center tightening bolt 54, the door panel main body 20 can be easily and finely adjusted for an mounting angle and mounting position. In other words, the tightening bolt 54 for fixing the center part of the first hinge plate 41 is loosened, by which the second hinge plates 43 arranged respectively at one end and the opposing end of the first hinge plate 41 in a longitudinal direction are movably adjusted on the basis of the tightening bolt 54. Thus, it is possible to smoothly mount the door panel main body 20, while making a fine adjustment for a position at which the integrally formed door panel main body 20 is mounted.

Further, since the long first hinge plate 41 acts as a plate for integrating a plurality of hinges, it is not necessary to weld a plate between a plurality of hinges for integrating a plurality of hinges. Thus, unlike welded hinges, it is possible to omit a welding process and also improve the rigidity of the hinge.

Still further, the foamed material 24 is filled between the outer panel 21 and the inner panel 23 to attain a reduction in weight of the door panel main body 20 and improvement of the vibration absorbing performance. Thus, it is possible to reduce loads acting on the hinge 31 and also improve the durability of the hinge 31.

Next, description will be made for the example illustrated in FIGS. 12 to 16. It is noted that parts similar to the example illustrated in FIGS. 1 to 6 will be given the same reference numerals and letters to omit the description thereof.

As illustrated in FIGS. 12 to 15, in a door unit having a door panel main body 20 and a hinge 31 in which one side of the door panel main body 20 is mounted to a frame 32, the hinge 31 is provided with a first hinge plate 41 fixed to the frame 32, a second hinge plate 43 installed so as to be capable of opening and closing with respect to the first hinge plate 41 to mount the door panel main body 20, a shaft member 42 for supporting pivotally the second hinge plate 43 so as to be capable of opening and closing with respect to the first hinge plate 41, and a hinge plate opening-angle restraining mechanism 71 installed from the first hinge plate 41 to the second hinge plate 43 to stop the opening movement of the second hinge plate 43 with respect to the first hinge plate 41 at a fixed angle.

The hinge plate opening-angle restraining mechanism 71 is provided with a guide plate 72 installed integrally at the first hinge plate 41, a guide hole 73H formed at a rod insertion plate portion 73 of the guide plate 72 at least in an elongated manner in a vertical direction, a receiving plate portion 74 located below the guide hole 73H and formed integrally from the rod insertion plate portion 73 of the guide plate 72 in a horizontal direction, an engaging hole 75 drilled at the receiving plate portion 74, a guide portion 76 continuously slanted downward toward the side opposite from the guide plate 72 via the engaging hole 75, a bracket portion 77 formed integrally from the second hinge plate 43 in a horizontal direction to have a shaft hole 78, and a hold-stay rod 79 installed between the shaft hole 78 of the bracket portion 77 and the guide hole 73H of the guide plate 72.

The hold-stay rod 79 is provided with a vertical shaft portion 79*a* loosely fitted perpendicularly into the shaft hole 78 of the bracket portion 77, a horizontal shaft portion 79*b* installed horizontally with respect to the vertical shaft portion 79*a* and inserted into the guide hole 73H of the guide plate 72 so as to be capable of sliding, and a stopper portion 79*c* which is formed by folding the leading end of the horizontal shaft portion 79*b* downward and perpendicularly, inserted into the engaging hole 75 by moving from the guide portion 76 to the receiving plate portion 74 due to the opening movement of the second hinge plate 43 with respect to the first hinge plate 41 and can be taken out from the engaging hole 75.

The bracket portion 77 is arranged at the end opposite from the side where the shaft member 42 is mounted at the second hinge plate 43.

Figure 14:
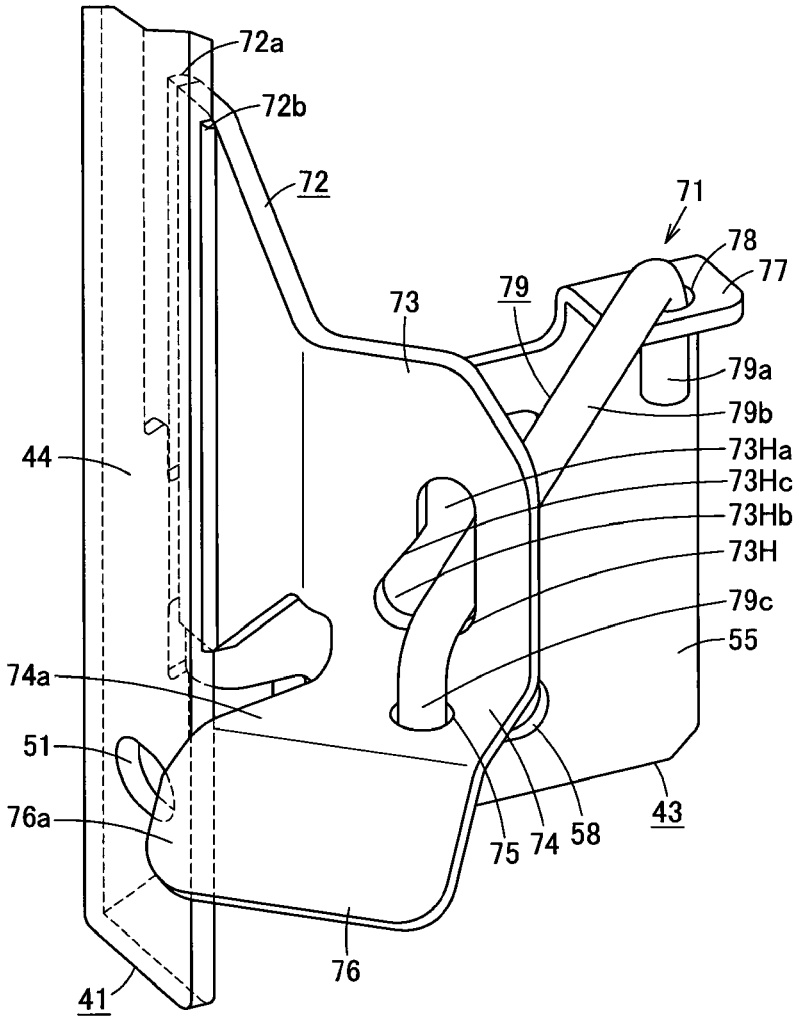
FIG. 14 is a perspective view of major parts of the hinge.

Further, as shown in FIG. 14, the guide hole 73H is provided with a vertical hole portion 73Ha formed in a vertical direction of the guide plate 72 and a horizontal hole portion 73Hb installed along the receiving plate portion 74 from a lower part of the vertical hole portion 73Ha toward the first hinge plate 41. In addition thereto, the guide hole 73H is provided with an oblique hole portion 73Hc formed by obliquely cutting off an inner angle portion between the vertical hole portion 73Ha and the horizontal hole portion 73Hb.

Figure 15:
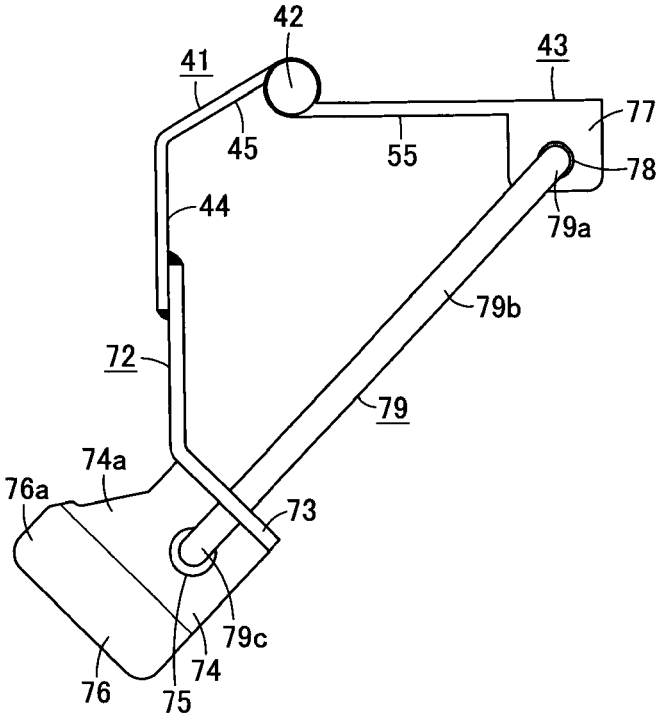
FIG. 15 is a plan view of the hinge.
Figure 16:
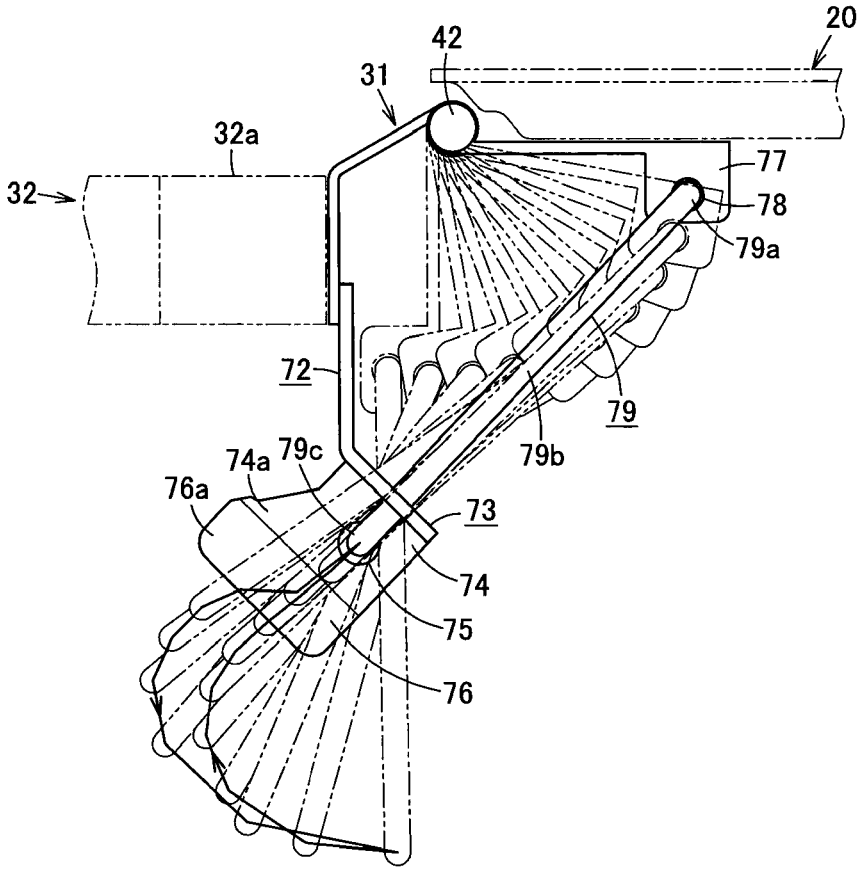
FIG. 16 is a plan view illustrating operating trajectories of the hinge.

Still further, as illustrated in FIGS. 14 to 16, on the side of the first hinge plate 41, protruded portions 74*a*, 76*a* are formed in an extended manner from the receiving plate portion 74 to the guide portion 76 in the guide plate 72.

Then, as illustrated in FIG. 16, when the hinge 31 is closed together with the door panel main body 20, the stopper portion 79*c* of the hold-stay rod 79 descends along the guide portion 76, while sliding on the receiving plate portion 74 and the guide portion 76 in a horizontal direction. At this time, the horizontal shaft portion 79*b* of the hold-stay rod 79 is capable of smoothly descending along the oblique hole portion 73Hc, while moving in a horizontal direction. In this instance, the protruded portions 74*a*, 76*a* are able to reliably prevent a concern that the stopper portion 79*c* of the hold-stay rod 79 may fall from the side edge of the receiving plate portion 74 and that of the guide portion 76.

Next, description will be made for the example illustrated in FIG. 17. It is noted that the same parts as those illustrated in FIG. 3 will be given the same reference numerals and letters to omit the description thereof.

The first hinge plate 41 is provided with a flat plate-like frame contacting plate portion 44 which is in contact with the frame 32 and attached tightly, a bearing plate portion 45 folded and formed with respect to the frame contacting plate portion 44, and a plurality of bearing annular portions 47 molded integrally at the bearing plate portion 45 and fitted into the shaft member 42.

The second hinge plate 43 is provided with a panel contacting plate portion 55 for fixing the door panel main body 20 and a plurality of bearing annular portions 48 molded integrally at the panel contacting plate portion 55 and fitted into the shaft member 42 alternately with the bearing annular portions 47 of the first hinge plate 41.

Then, the first hinge plate 41 is provided with end portions 44*a*, 45*a* formed by allowing the frame contacting plate portion 44 and the bearing plate portion 45 to protrude in a longitudinal direction from the respective bearing annular portions 47, 48 of the first hinge plate 41 and the second hinge plate 43.

These end portions 44*a*, 45*a* are protruded downward only by a distance L from the lower end of the frame contacting plate portion 44 and that of the bearing plate portion 45 that are illustrated in FIG. 3. This distance L is desirably approximately 20 mm to which the present invention shall not be, however, limited.

In response to the fact that a circular-arc portion 49*a* is formed at a corner of the end portion 44*a* of the frame contacting plate portion 44, a chamfered portion 49*b* formed by being cut obliquely is installed at a corner of the end portion 45*a* of the bearing plate portion 45, thereby facilitating the handling of the hinge 31. Thus, the hinge 31 can be used to conduct assembly work efficiently.

Figure 17:
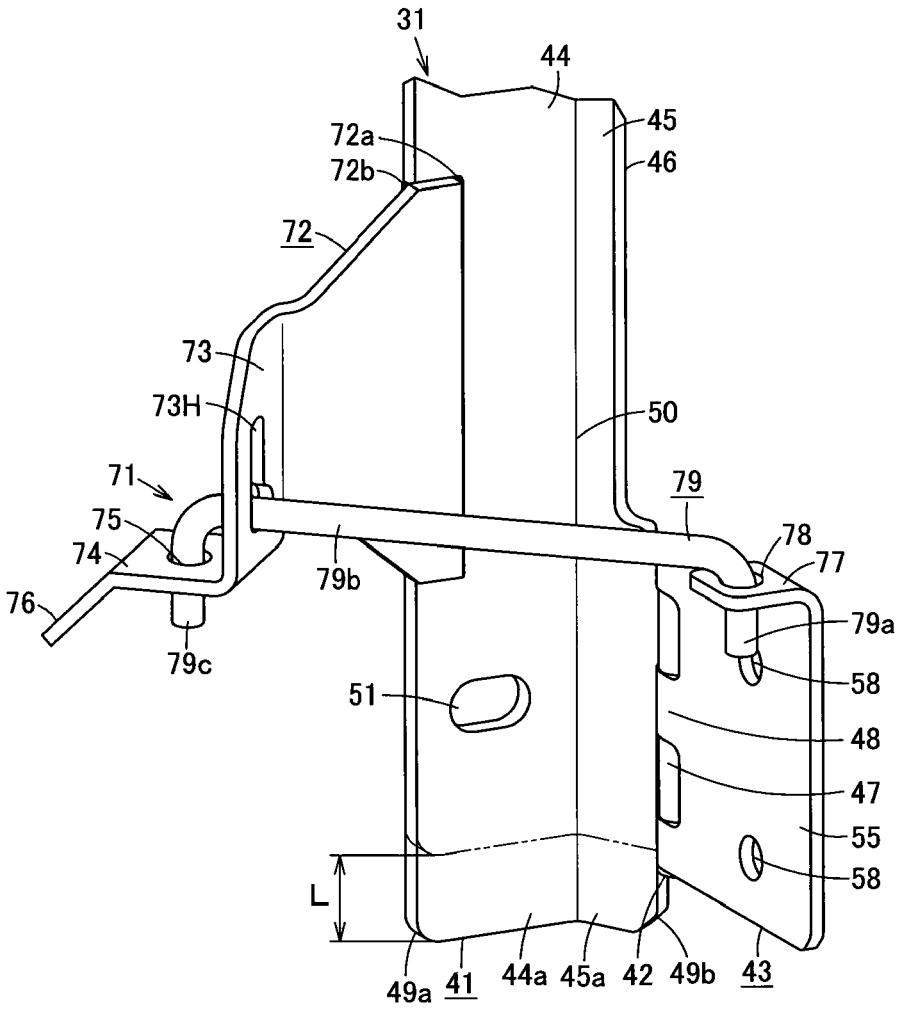
FIG. 17 is a perspective view illustrating major parts of a third embodiment of the hinge used in the door unit of the present invention.

In the above-described constitution of the example illustrated in FIG. 17, there is a concern that at a processing stage where the frame contacting plate portion 44 and the bearing plate portion 45 in the first hinge plate 41 are folded and formed, there may be found a decrease in strength along a folded line 50 between the frame contacting plate portion 44 and the bearing plate portion 45. Since the leading end of the folded line 50 is in particular vulnerable to loads acting directly from the side thereof, the frame contacting plate portion 44 and the bearing plate portion 45 in the first hinge plate 41 are allowed to protrude in a longitudinal direction from the bearing annular portions 47, 48 fitted into the shaft member 42, thereby forming end portions 44*a*, 45*a*. And, the leading end of the folded line 50 is positioned so as to be distant only by the distance L, thereby distributing stress when loads of the door panel main body 20 act on the first hinge plate 41 from the second hinge plate 43 by way of the shaft member 42 and the bearing annular portions 47, 48. Thereby, load stress acting on the leading end of the folded line 50 is lowered to reduce the concentration of the stress at the leading end, thus making it possible to improve the durability of the leading end portion of the folded line 50 and also prevent the occurrence of cracks and breakage.

Next, description will be made for the example illustrated in FIGS. 18 to 28. It is noted that the work machine, the side door structure and the door mounting structure illustrated in FIGS. 7 to 11 are all the same to omit description about their structures.

FIGS. 18 to 22 illustrate structures of the hinge 31. The hinge 31 is provided with a single first hinge plate 41 formed long in a direction of a frame on the side fixed to a first side member 32*a* of the frame 32 on a machine body, a plurality of shaft members 42 whose rotating center axes are arranged on the same straight line along a longitudinal direction at one side portion of one end and that of the opposing end of the first hinge plate 41 in a longitudinal direction, and a plurality of second hinge plates 43 supported pivotally by these shaft members 42 so as to be capable of opening and closing with respect to the first hinge plate 41 to mount a door panel main body 20.

In the first hinge plate 41, a bearing plate portion 45 is folded and formed with respect to a flat plate-like frame contacting plate portion 44. Then, a plurality of bearing annular portions 47 molded integrally at one end and the opposing end via a center notch 46 of the bearing plate portion 45 and a plurality of bearing annular portions 48 integrally molded respectively on a plurality of second hinge plates 43 are fitted alternately, and the shaft member 42 is inserted into these bearing annular portions.

Figure 18:
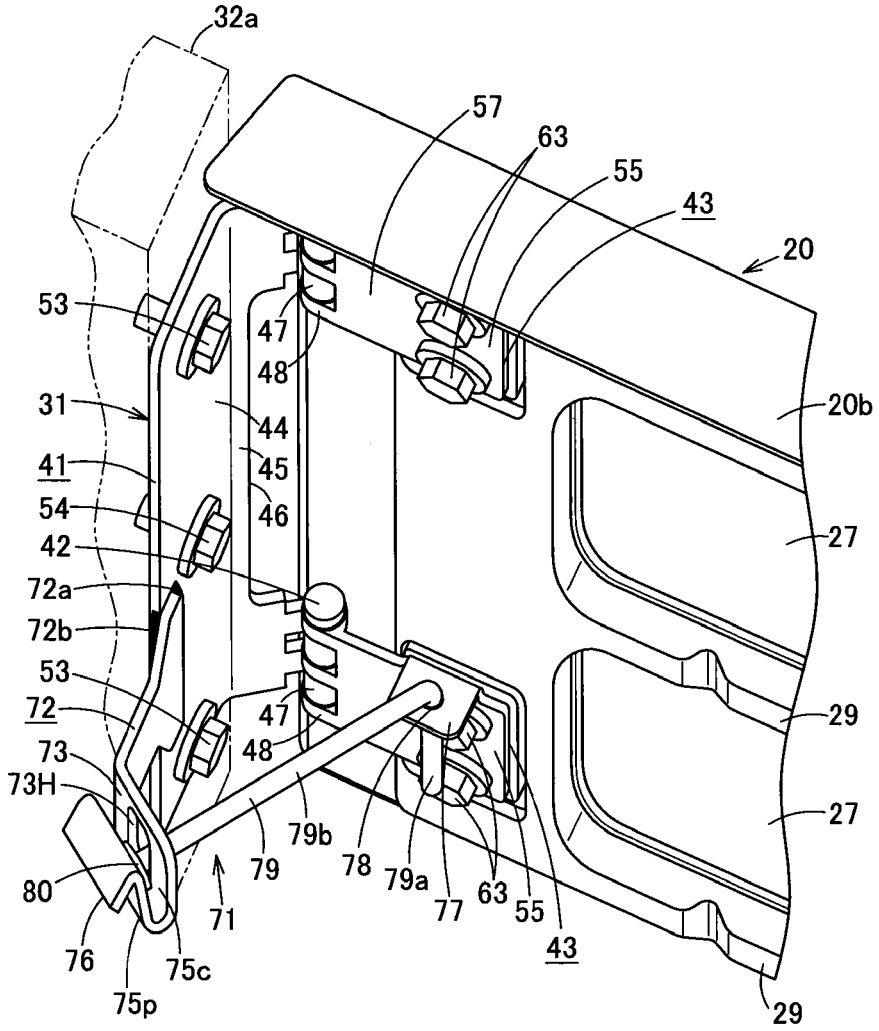
FIG. 18 is a perspective view illustrating a fourth embodiment of a hinge mounting portion of the door unit used in the present invention.
Figure 19:
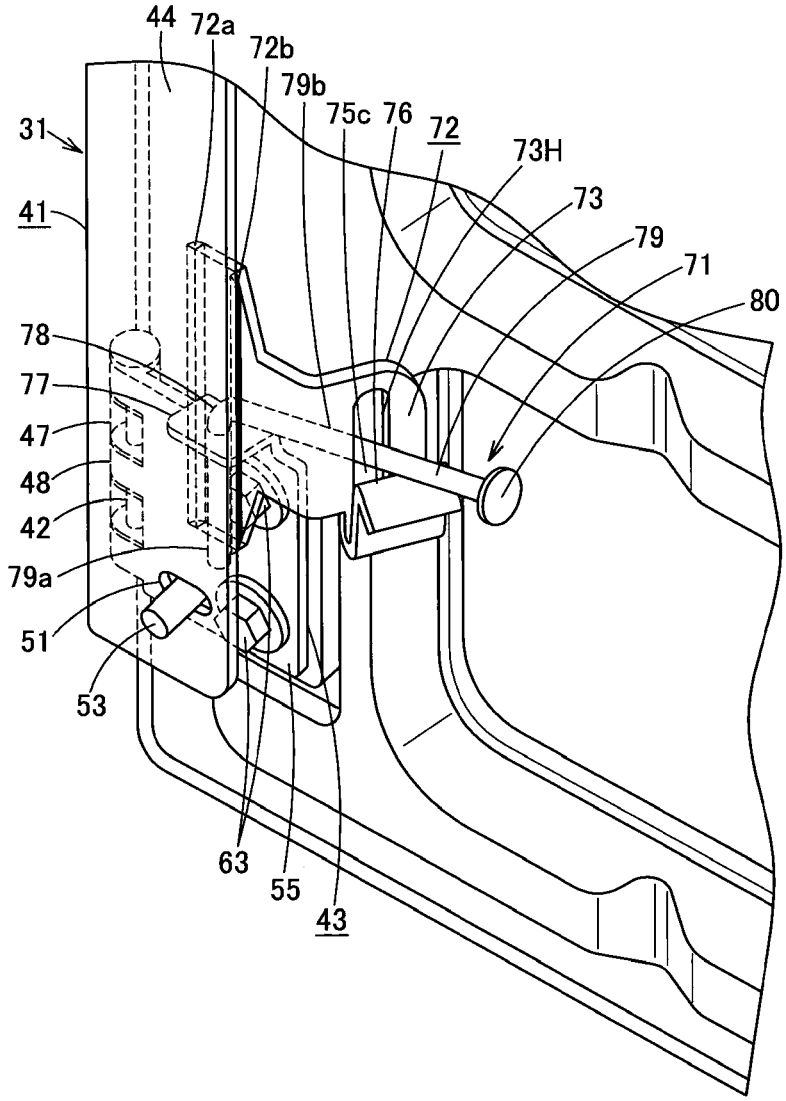
FIG. 19 is a perspective view illustrating major parts of the door unit.
Figure 20:
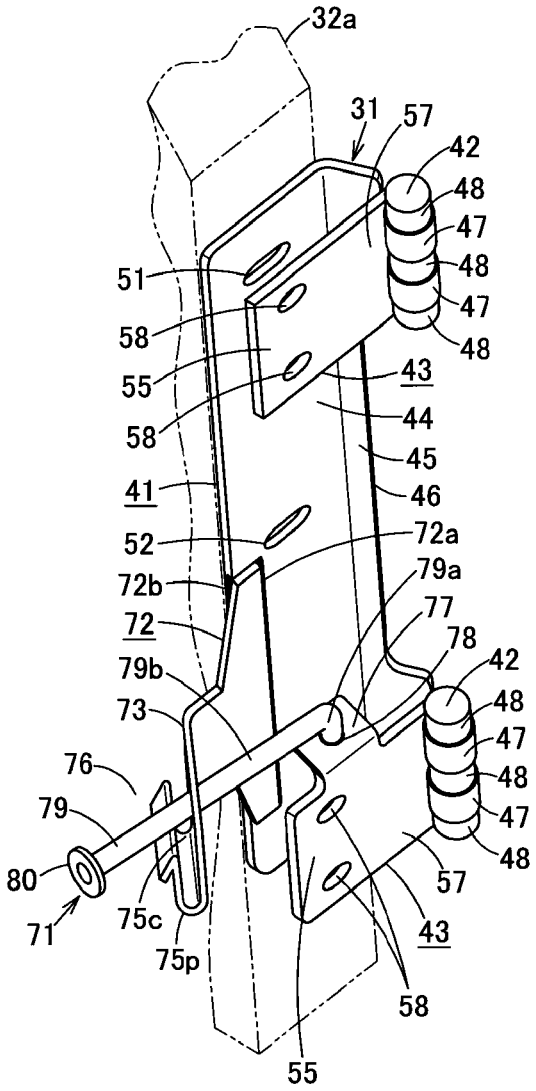
FIG. 20 is a perspective view illustrating the hinge of the door unit.
Figure 21:
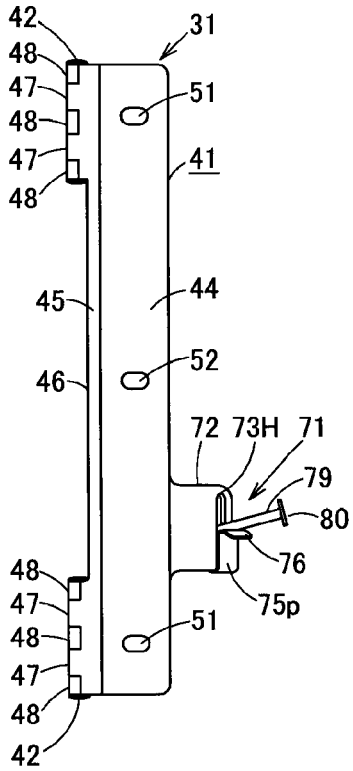
FIG. 21 is a front elevational view illustrating the hinge of the door unit.
Figure 22:
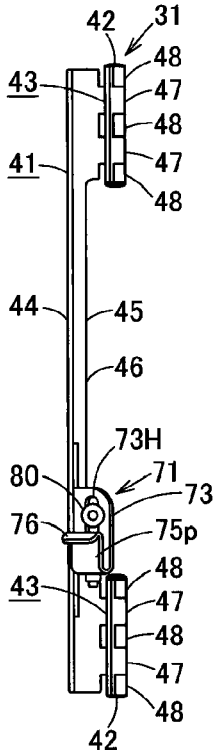
FIG. 22 is a side elevational view illustrating the hinges of the door unit.

Elongated holes for tightening-bolt insertion 51, 52, 51 are drilled at one end, a center part and the opposing end in the frame contacting plate portion 44 of the first hinge plate 41. As illustrated in FIG. 18, the frame contacting plate portion 44 can be fixed to a first side member 32*a* of the frame 32 on the machine body and also can be loosened by using tightening bolts 53, 54, 53 inserted into the elongated holes 51, 52, 51.

Further, as illustrated in FIG. 11, in the upper and lower second hinge plates 43, a bolt insertion hole 58 for fixing the door panel main body 20 is drilled on the panel contacting plate portion 55 to mold integrally for the bearing annular portion 48.

When the hinge 31 mounted to a side door 17 as described above is used to mount the side door 17 to the frame 32 on the machine body, as illustrated in FIG. 18, tightening bolts 53, 54, 53 inserted into the elongated holes 51, 52, 51 on the first hinge plate 41 are screwed into nut members installed on the first side member 32*a* of the frame 32 and attached tightly. In this instance, in a state where the tightening bolts 53, 54, 53 are loosened, the door panel main body 20 is allowed to move in a range where these tightening bolts 53, 54, 53 are allowed to move inside the elongated holes 51, 52, 51, thereby making a fine adjustment for a position at which the door panel main body 20 is mounted.

As illustrated in FIGS. 18 to 22, from the first hinge plate 41 to the second hinge plate 43, there is provided a hinge plate opening-angle restraining mechanism 71 for stopping the opening movement of the second hinge plate 43 with respect to the first hinge plate 41 at a fixed angle.

In the hinge plate opening-angle restraining mechanism 71, a guide plate 72 which has a guide hole 73H formed in an elongated manner in a vertical direction and which is a plate member different from the first hinge plate 41 is integrally mounted to the first hinge plate 41 by an inner welded portion 72*a* and an outer welded portion 72*b*. A pocket portion 75*p* which is opened on side surfaces to have a recessed accommodating portion 75*c* is folded and formed from a lower part of the guide plate 72. A guide portion 76 is folded and formed so as to slant downward toward the outside of the pocket portion 75*p* from the upper edge of the pocket portion 75*p*. Further, an integrally molded bracket portion 77 is folded to the guide plate 72 side and formed at the upper edge of the lower second hinge plate 43. A vertical shaft portion 79*a* of an L-shaped rod 79 as the hold-stay rod is loosely fitted into a shaft hole 78 of the bracket portion 77 so as to be capable of moving rotationally and also sliding in a vertical direction. A horizontal shaft portion 79*b* of the L-shaped rod 79 is fitted into the guide hole 73H of the guide plate 72 so as to be capable of sliding. And, a stopping plate portion 80 which moves together with the L-shaped rod 79 by the opening movement of the second hinge plate 43 with respect to the first hinge plate 41 and falls into the pocket portion 75*p* from the guide portion 76 is integrally mounted to the leading end portion of the L-shaped rod 79.

Next, description will be made for actions and effects of the example illustrated in FIGS. 18 to 28.

Figure 23:
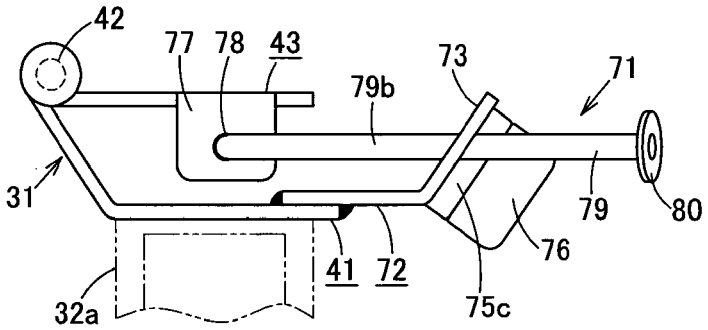
FIG. 23 is a plan view illustrating the hinge in a state where the door unit is closed.
Figure 24:
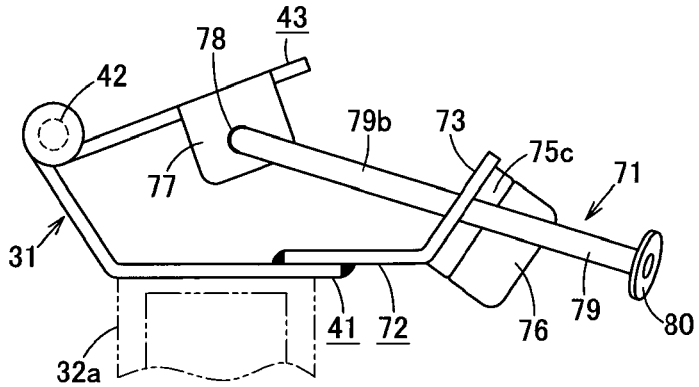
FIG. 24 is a plan view illustrating the hinge in a state where the door unit is opened at an angle of 20°.
Figure 25:
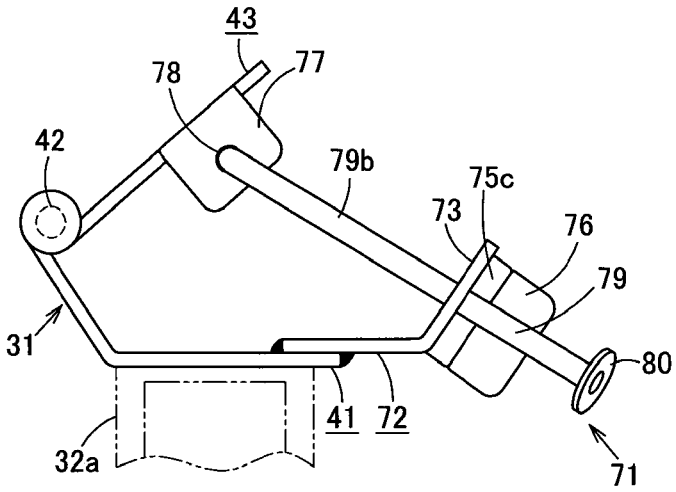
FIG. 25 is a plan view illustrating the hinge in a state where the door unit is opened at an angle of 40°.
Figure 26:
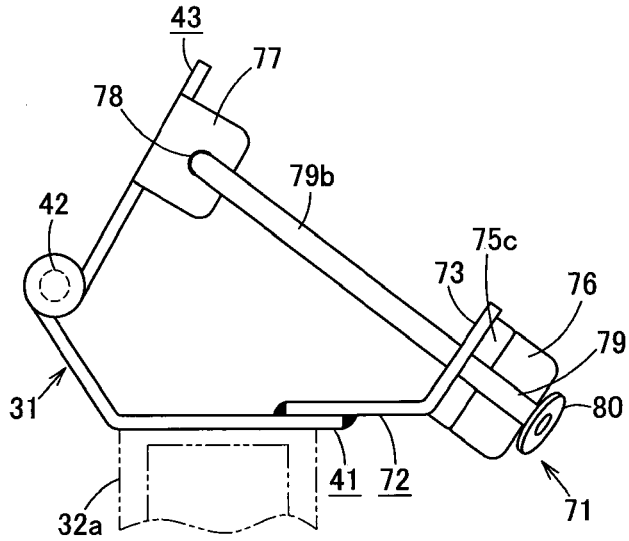
FIG. 26 is a plan view illustrating the hinge in a state where the door unit is opened at an angle of 60°.
Figure 27:
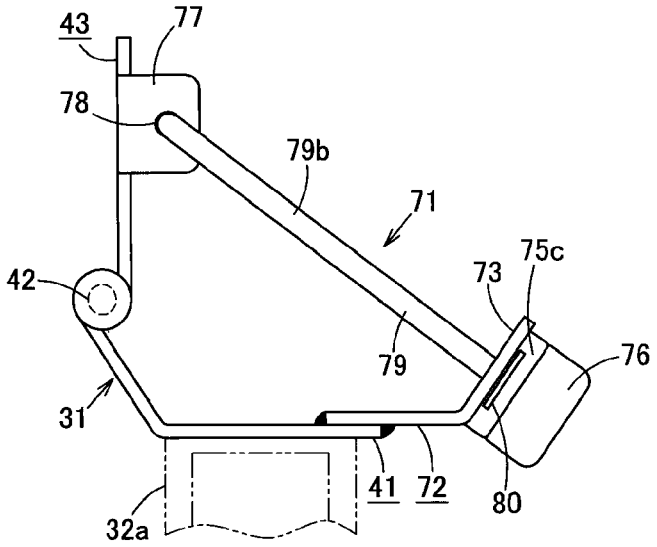
FIG. 27 is a plan view illustrating the hinge in a state where the door unit is fully opened or at an angle of 90°.

FIGS. 23 to 27 illustrate a series of movements by the hinge 31 when the door panel main body 20 is opened. FIG. 23 illustrates a state where the door panel main body 20 is closed, FIG. 24 illustrates a state where the door panel main body 20 is opened at an angle of 20°, FIG. 25 illustrates a state where the door panel main body 20 is opened at an angle of 40°, FIG. 26 illustrates a state where the door panel main body 20 is opened at an angle of 60°, and FIG. 27 illustrates a state where the door panel main body 20 is fully opened or at an angle of 90°.

As illustrated in FIGS. 23 to 27, at a stage that the door panel main body 20 is opened, the L-shaped rod 79 kept fitted into the guide hole 73H of the guide plate 72 moves so as to slide on the uppermost part of the guide portion 76, while making a relative rotational movement with respect to the second hinge plate 43 in a horizontal direction.

Figure 28:
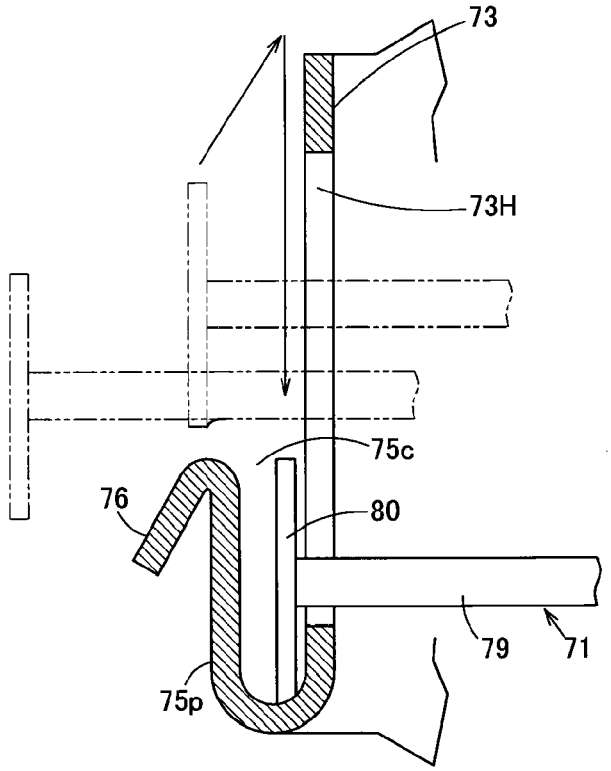
FIG. 28 is a sectional view illustrating the hinge in a locked state when the door unit is fully opened.

Then, as illustrated in FIGS. 27 and 28, in a state where the door panel main body 20 is fully opened, a stopping plate portion 80 capable of moving upward together with the L-shaped rod 79 loosely fitted into the shaft hole 78 of the bracket portion 77 climbs up a gradient of the guide portion 76 and thereafter falls along the guide hole 73H in a vertical direction into the accommodating portion 75*c* inside the pocket portion 75*p* from the uppermost part of the guide portion 76. Thereby, the movement of the L-shaped rod 79 with respect to the first hinge plate 41 can be restricted to lock the opening and closing movement of the second hinge plate 43 via the L-shaped rod 79. In other words, it is possible to lock the opening and closing movement of the door panel main body 20 mounted to the second hinge plate 43.

Where locking actions are released in the fully opened state, the L-shaped rod 79 loosely fitted into the shaft hole 78 of the bracket portion 77 is pushed up along the guide hole 73H, allowing the stopping plate portion 80 to move upward from the uppermost part of the guide portion 76. Thereby, the stopping plate portion 80 is released from the accommodating portion 75*c* inside the pocket portion 75*p*, and the second hinge plate 43 is allowed to move in a closing direction. In other words, it is possible to close the door panel main body 20 mounted to the second hinge plate 43.

When the door panel main body 20 is closed, as illustrated in FIG. 8, the latching mechanism portion 34 of the door panel main body 20 moves toward a striker 36 protruded from the second side member 32*b* of the frame 32 and is restricted and stopped by a hook of the striker 36. At the same time, a vibration-damping plunger 38 installed on the frame 32 is fitted into a recessed vibration-damping engaging portion 37 installed at a perpendicular surface portion 20*a* of the door panel main body 20, thereby restraining vertical vibration of the door panel main body 20.

As illustrated in FIG. 9, the door panel main body 20 can attain a reduction in weight by adopting a hollow closed-cross-section structure formed with the outer panel 21 and an inner panel 23 thinner than the outer panel 21. The strong door panel main body 20 capable of securing strength sufficient to bear external impact can also be provided at reasonable cost by adopting a sufficiently-high and hollow closed-cross-section structure formed with the inner panel 23 and the outer panel 21 thicker than the inner panel 23. Further, the foamed material 24 filled between the outer panel 21 and the inner panel 23 is capable of effectively damping sounds resulting from the door panel main body 20 in itself. Therefore, it is possible to effectively attain a reduction in ambient noise.

Further, the hinge plate opening-angle restraining mechanism 71 for stopping the opening movement of the second hinge plate 43 with respect to the first hinge plate 41 at a fixed angle is installed from the first hinge plate 41 to the second hinge plate 43. In other words, the first and second hinge plates 41, 43 act as brackets 19*a*, 19*b*, 19*d* (refer to FIGS. 32 to 34) of the holding mechanism 19 installed on a conventional frame and a conventional door, thereby eliminating the need for additionally installing brackets on the frame 32 and the door panel main body 20 in the machine body. It is, thus, possible to make unnecessary additional components and a welding process thereof.

Further, the L-shaped rod 79 is always fitted into the guide hole 73H of the guide plate 72 of the first hinge plate 41, while kept coupled into the bracket portion 77 of the second hinge plate 43 and is not removed. Therefore, even when great vibration occurs at the time of closing a door (at the time of working), no additional components are needed to prevent falling. And, at the time of opening the door, the stopping plate portion 80 installed at the leading end portion of the L-shaped rod 79 moves together with the L-shaped rod 79 and falls into the pocket portion 75*p* so as to ride over the guide portion 76. Thus, in association with the movement of fully opening the door, fixing functions can be automatically activated to automatically secure a state where the door panel main body 20 is opened at a fully opened angle.

Still further, according to the above-described constitution, components can be downsized as compared with a conventional holding mechanism 19, by which the components can be kept compact within the hinge 31.

In particular, the vertical shaft portion 79*a* of the L-shaped rod 79 is loosely fitted into the shaft hole 78 of the bracket portion 77 formed integrally at the second hinge plate 43 so as to be capable of moving rotationally and sliding in a vertical direction. Thereby, the hinge plate opening-angle restraining mechanism 71 can be made simple in structure to attain a cost reduction and easy change in strength on the basis of an easily attachable and detachable structure of the L-shaped rod 79.

Further, since the guide plate 72 having the pocket portion 75*p* and the guide portion 76 which have been sequentially folded and formed is welded to the first hinge plate 41, it is possible to easily manufacture the hinge plate opening-angle restraining mechanism 71 and reduce costs.

Still further, a plurality of second hinge plates 43 are supported pivotally on the long first hinge plate 41 by using a plurality of shaft members 42 arranged on the same straight line so as to be capable of opening and closing, thereby integrating two hinges into one hinge. Thereby, no reciprocal adjustment is needed between these two hinges, thus making it possible to easily and finely adjust a state where a door is mounted. The first hinge plate 41 can be mounted to the frame 32 with three tightening bolts 53, 54, 53, thereby reducing the number of mounting bolts. It is possible to improve the mounting workability by using the hinge 31 and also easily and finely adjust a state where the door is mounted.

In particular, when the door panel main body 20 is allowed to move so as to move rotationally around the center tightening bolt 54, the door panel main body 20 can be easily and finely adjusted for a mounting angle and mounting position. In other words, the tightening bolt 54 for fixing the center part of the first hinge plate 41 is loosened, by which the second hinge plates 43 arranged respectively at one end and the opposing end of the first hinge plate 41 in a longitudinal direction are movably adjusted on the basis of the tightening bolt 54. Thus, it is possible to smoothly mount the door panel main body 20, while making a fine adjustment for a position at which the integrally formed door panel main body 20 is mounted.

Further, since the long first hinge plate 41 acts as a plate for integrating a plurality of hinges, it is not necessary to weld a plate between a plurality of hinges for integrating a plurality of hinges. Thus, unlike welded hinges, it is possible to omit a welding process and also improve the rigidity of the hinge.

Still further, the foamed material 24 is filled between the outer panel 21 and the inner panel 23 to attain a reduction in weight of the door panel main body 20 and improvement of vibration absorption performance. Thus, it is possible to reduce loads acting on the hinge 31 and also improve the durability of the hinge 31.

Figure 29:
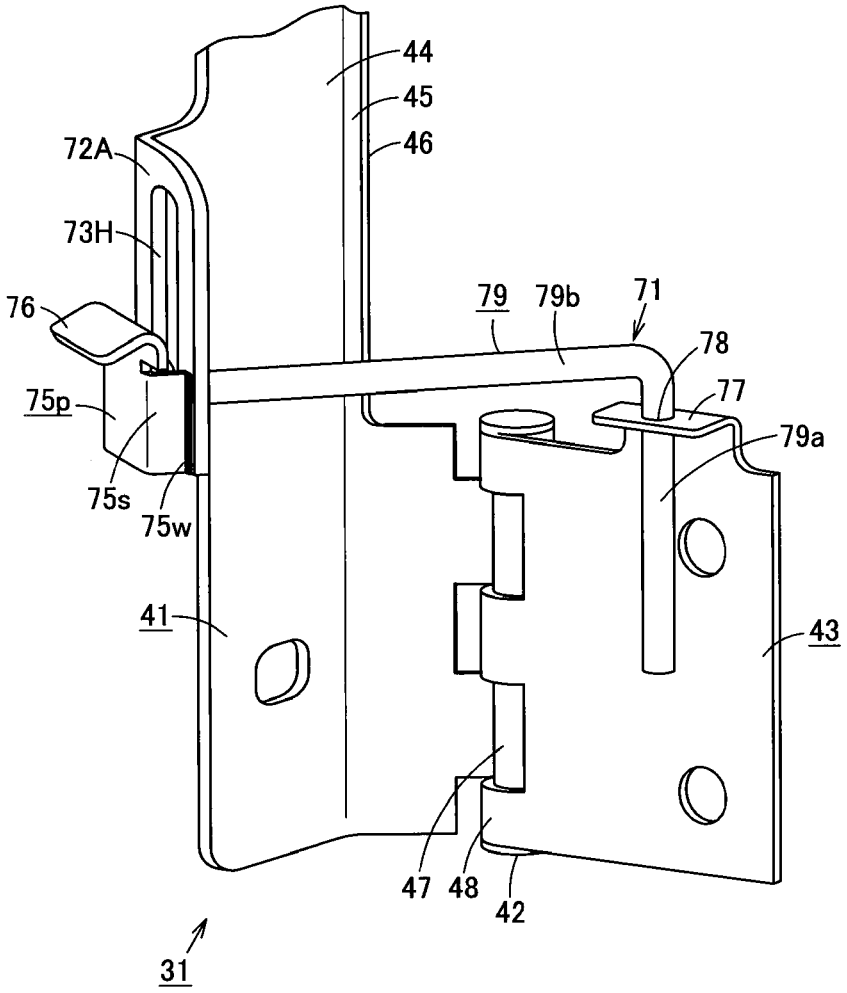
FIG. 29 is a perspective view illustrating a fifth embodiment of the hinge used in the door unit.

Next, FIG. 29 illustrates another example. The guide plate 72A having a guide hole 73H of the hinge plate opening-angle restraining mechanism 71 is molded with a member integral with the first hinge plate 41. The pocket portion 75*p* having a side surface portion 75*s* formed in a closed shape is formed integrally with the welded portion 75*w* welded to the guide plate 72A by using a member different from the guide plate 72A. The guide portion 76 is folded and formed from the upper edge of the pocket portion 75*p*. Other constitutions are the same as those illustrated in FIG. 18 to omit description thereof.

According to the example illustrated in FIG. 29, the pocket portion 75*p* formed with a different member is welded to the guide plate 72A molded with a member formed integrally with the first hinge plate 41. Therefore, as illustrated in FIG. 18, it is possible to mount later the pocket portion 75*p*, the shape of which is difficult to manufacture by integral molding with the guide plate 72.

Figure 30:
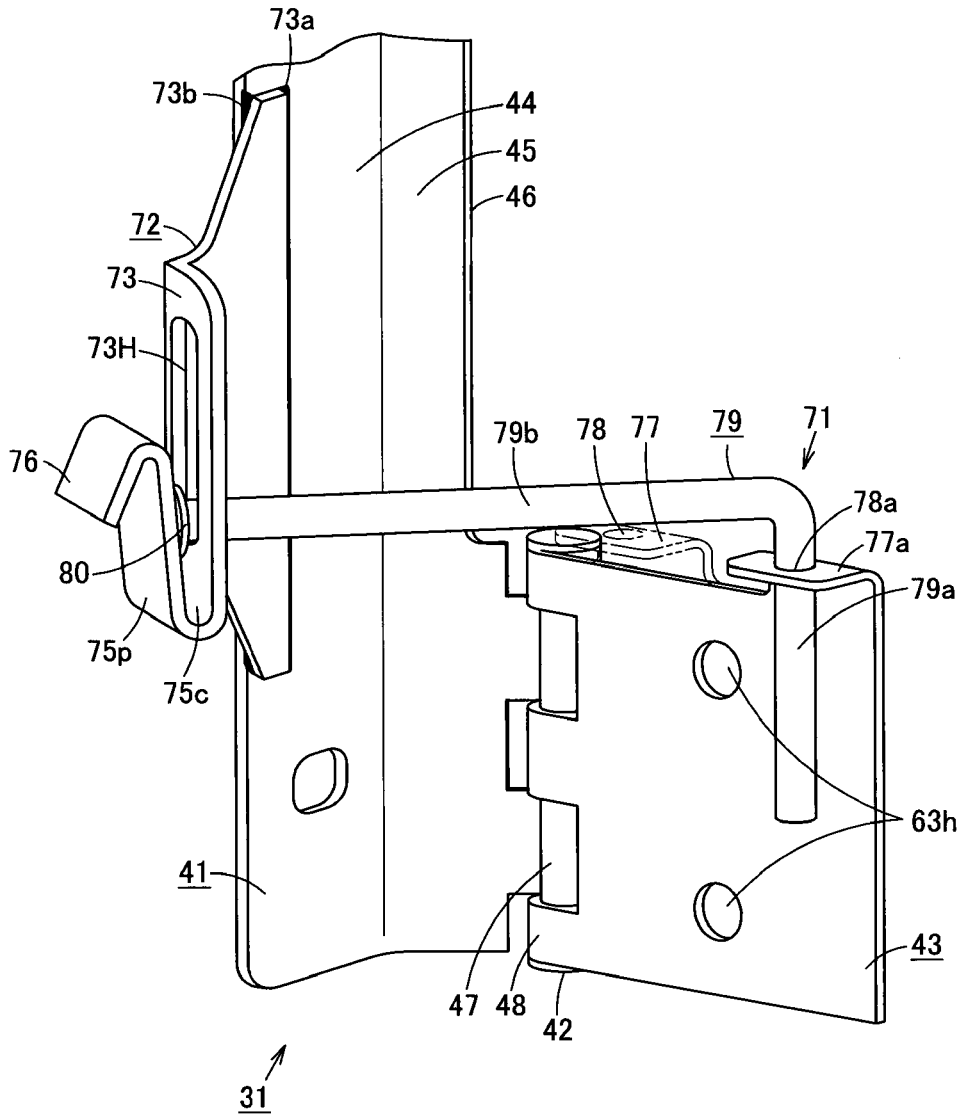
FIG. 30 is a perspective view illustrating a sixth embodiment of the hinge used in the door unit.
Figure 31:
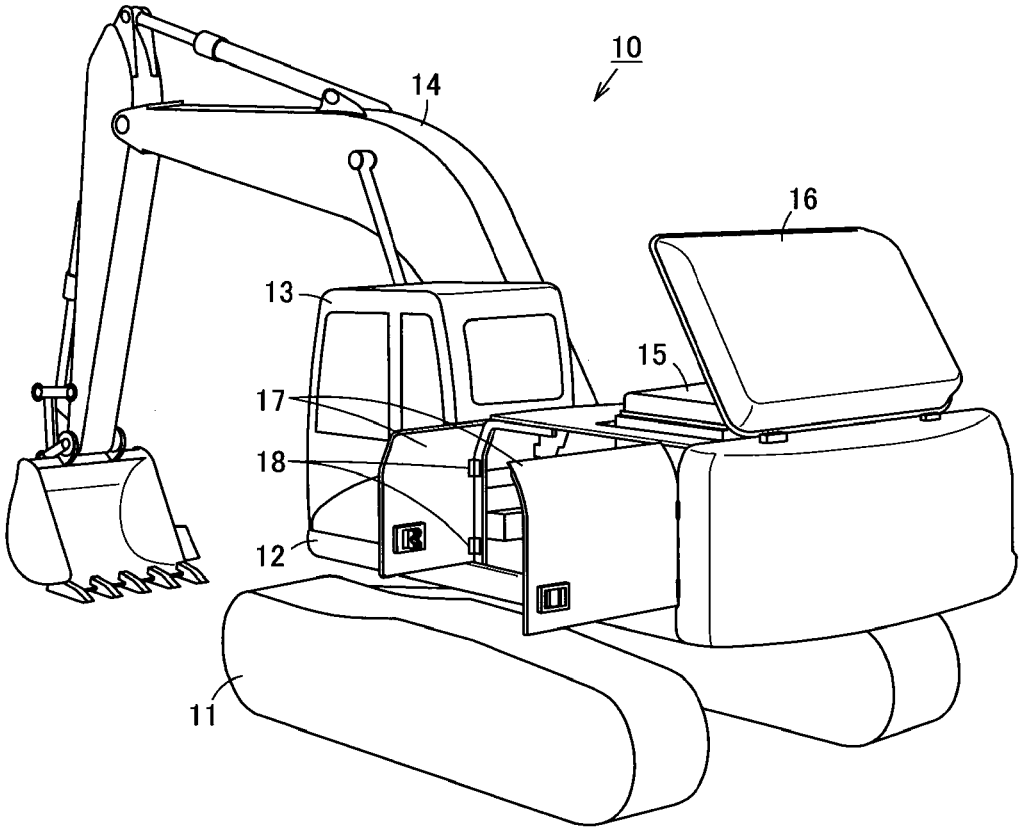
FIG. 31 is a perspective view of a work machine provided with a conventional door unit.

Then, FIG. 30 illustrates a further example. The bracket portion 77 and the shaft hole 78 for loading the vertical shaft portion 79*a* of the L-shaped rod 79 shall not be limited to predetermined positions. The bracket portion 77 and the shaft hole 78 may be allowed to move, for example, from the position indicated by the double dotted and dashed line to a position at which the horizontal shaft portion 79*b* of the L-shaped rod 79 is extended from the bolt insertion holes 63*h* which are drilled on the second hinge plate 43 for mounting the door panel, like the bracket portion 77*a* and the shaft hole 78*a* indicated by the solid line.

It is noted that, as the hinge plate opening-angle restraining mechanism 71, in addition to the illustrated slide type mechanism, there may be available a mechanism in which a plurality of links are folded freely from the first hinge plate 41 to the second hinge plate 43.

The hinge and the door unit of the present invention are applicable to aside door and a rear door used in work machines such as a hydraulic excavator.

The invention claimed is:

1. A hinge comprising:

a first hinge plate fixed to a frame;

a second hinge plate installed so as to be capable of opening and closing with respect to the first hinge plate to mount a door panel main body;

a shaft member supporting pivotally the second hinge plate so as to be capable of opening and closing with respect to the first hinge plate; and a hinge plate opening-angle restraining mechanism installed from the first hinge plate to the second hinge plate to stop the opening movement of the second hinge plate with respect to the first hinge plate at a fixed angle;

wherein the hinge plate opening-angle restraining mechanism comprises:

a guide plate installed integrally at the first hinge plate, a guide hole formed in an elongated manner at least in a vertical direction of the guide plate, a receiving plate portion installed integrally in a horizontal direction from the guide plate below the guide hole, an engaging hole drilled at the receiving plate portion, a guide portion continuously slanted downward toward a side opposite from the guide plate, a bracket portion installed integrally in a horizontal direction from the second hinge plate, and wherein the bracket portion includes a shaft hole, and a hold-stay rod installed between the shaft hole of the bracket portion and the guide hole of the guide plate, and wherein the hold-stay rod comprises:

a vertical shaft portion loosely fitted perpendicularly into the shaft hole of the bracket portion, a horizontal shaft portion installed horizontally with respect to the vertical shaft portion and inserted into the guide hole of the guide plate so as to be capable of sliding, and a stopper portion formed by folding the leading end of the horizontal shaft portion downward perpendicularly, inserted into the engaging hole by moving from the guide portion to the receiving plate portion due to opening movement of the second hinge plate with respect to the first hinge plate, and capable of being taken out from the engaging hole.

2. The hinge according to claim 1, wherein the bracket portion is arranged at the end opposite from the side where the shaft member is mounted at the second hinge plate.

3. The hinge according to claim 1, wherein the guide hole comprises a vertical hole portion formed in a vertical direction of the guide plate and a horizontal hole portion formed along the receiving plate portion from a lower part of the vertical hole portion toward the first hinge plate.

4. The hinge according to claim 3, wherein the guide hole comprises an oblique hole portion formed by obliquely cutting off an inner angle portion between the vertical hole portion and the horizontal hole portion.

5. The hinge according to claim 1, wherein the first hinge plate comprises:

a flat plate-like frame contacting plate portion in contact with the frame and attached tightly, a bearing plate portion folded and formed with respect to the frame contacting plate portion, and a plurality of bearing annular portions molded integrally at the bearing plate portion and fitted into the shaft member, the second hinge plate comprises:

a panel contacting plate portion fixing a door panel main body, and a plurality of bearing annular portions molded integrally at the panel contacting plate portion and fitted into the shaft member alternately with the bearing annular portions of the first hinge plate, and the first hinge plate further comprises:

end portions formed by allowing the frame contacting plate portion and the bearing plate portion to protrude from the bearing annular portion of the first hinge plate and that of the second hinge plate in a longitudinal direction.

6. A door unit comprising:

a door panel main body; and the hinge according to claim 1 in which one side of the door panel main body is mounted to a frame; wherein the door panel main body comprises:

an outer panel, an inner panel fixed to the inner surface of the outer panel, and a foamed material filled between the outer panel and the inner panel.

* * * * *

UNITED STATES PATENT AND TRADEMARK OFFICE

CERTIFICATE OF CORRECTION

PATENT NO. : 8,413,382 B2
APPLICATION NO. : 13/056185
DATED : April 9, 2013
INVENTOR(S) : Ryoji Uto et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 148 days.

Signed and Sealed this
Twenty-seventh Day of August, 2013

Teresa Stanek Rea
*Acting Director of the United States Patent and Trademark Office*